US007673603B2

(12) United States Patent
Yamamoto et al.

(10) Patent No.: US 7,673,603 B2
(45) Date of Patent: Mar. 9, 2010

(54) VALVE TIMING CONTROL DEVICE AND ENGINE DEVICE AND VEHICLE INCLUDING THE SAME

(75) Inventors: Minoru Yamamoto, Shizuoka (JP); Yoshitaka Nagai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 315 days.

(21) Appl. No.: 11/721,900

(22) PCT Filed: Dec. 7, 2005

(86) PCT No.: PCT/JP2005/022483

§ 371 (c)(1), (2), (4) Date: Jul. 24, 2007

(87) PCT Pub. No.: WO2006/064706

PCT Pub. Date: Jun. 22, 2006

(65) Prior Publication Data

US 2009/0250024 A1 Oct. 8, 2009

(30) Foreign Application Priority Data

Dec. 17, 2004 (JP) ..... 2004-365550

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,785,017 A 7/1998 Saito et al.
5,809,953 A 9/1998 Saito et al.
5,836,274 A 11/1998 Saito et al.
5,901,674 A 5/1999 Fujiwaki
6,170,448 B1 * 1/2001 Asakura ..... 123/90.18

FOREIGN PATENT DOCUMENTS

JP 62-070611 A 4/1987
JP 1-157208 U 10/1989
JP 2-050105 U 4/1990

(Continued)

OTHER PUBLICATIONS

Official Communication for PCT Application No. PCT/JP2005/022483; mailed on Mar. 14, 2006.

(Continued)

*Primary Examiner*—Zelalem Eshete
(74) *Attorney, Agent, or Firm*—Keating & Bennett, LLP

(57) ABSTRACT

When an engine operates at low engine speed, the tip end of a cam nose of an intake cam is at a second position. As the engine speed increases and exceeds a first engine speed, the tip end of the cam nose of the intake cam moves to a first position. When the engine operates at high engine speed, the tip end of the cam nose of the intake cam is at the first position. As the engine speed decreases and becomes lower than a second engine speed smaller than the first engine speed, the tip end of the cam nose of the intake cam moves to the second position different from the first position.

8 Claims, 14 Drawing Sheets

FOREIGN PATENT DOCUMENTS

| | | | |
|---|---|---|---|
| JP | 05-001514 | A | 1/1993 |
| JP | 5-21104 | U | 3/1993 |
| JP | 06-280515 | A | 10/1994 |
| JP | 08-144721 | A | 6/1996 |
| JP | 08-338213 | A | 12/1996 |
| JP | 2647506 | B2 | 8/1997 |
| JP | 09-250313 | A | 9/1997 |
| JP | 09-324614 | A | 12/1997 |
| JP | 10-220207 | A | 8/1998 |
| JP | 11-229831 | A | 8/1999 |
| JP | 2003-020963 | A | 1/2003 |
| JP | 2004-052729 | A | 2/2004 |

OTHER PUBLICATIONS

Minoru Yamamoto et al.; "Valve Timing Control Device and Engine Device and Vehicle Including the Same"; U.S. Appl. No. 11/721,895, filed Jun. 15, 2007.

* cited by examiner

VALVE TIMING CONTROL DEVICE AND ENGINE DEVICE AND VEHICLE INCLUDING THE SAME

BACKGROUND OF THE INVENTION

1. Field of the Invention

The present invention relates to a valve timing control device that controls the valve timing of an engine in a variable manner, and an engine device and a vehicle including such a control device.

2. Description of the Related Art

Many kinds of variable valve timing (VVT) mechanisms that control the opening/closing timings of an intake valve or an exhaust valve have been developed in order to improve fuel consumption, reduce toxic substances in exhaust gas, and achieve high power output in a target engine speed range.

Some of the variable valve timing mechanisms use an actuator such as a hydraulic cylinder and an electric motor. However, these actuators are expensive and the use of such an actuator increases the size of the variable valve timing mechanism.

In general, the space occupied by an engine in a motorcycle is smaller than that of a four-wheeled automobile and the like. There has been a demand for motorcycles that can be manufactured less costly. Therefore, there is a demand for more inexpensive and compact variable valve timing mechanisms for use in motorcycles. This is why the variable valve timing mechanisms including actuators as described above cannot be used in motorcycles.

A rotation phase generator has been suggested as a variable valve timing mechanism that can be made compact (see, for example, Japanese Laid Open Patent No. 09-324614 (Patent Document 1)).

In the rotation phase generator, an input member including two intermediate members is rotated with the rotation of the engine. When centrifugal forces acting on a weight portion of the two intermediate members is greater than the biasing force of a coil spring connecting these intermediate members, the rotation phases of the input member and an output member connected to a camshaft change, so that the valve timing changes.

With the rotation phase generator disclosed in Patent Document 1, the valve timing is controlled depending on the mechanical arrangement, and therefore the cost and size can be reduced.

However, the following problems associated with the above-described variable valve timing mechanism have been pointed out.

In the rotation phase generator disclosed in Patent Document 1, when the valve timing changes, centrifugal forces acting on the weight portion balances with the biasing force of the coil spring in a certain engine speed range of the engine. At that time, while the cam makes one rotation, a force (resistance force) in the forward or backward rotation direction constantly acts on the cam. The resistance force results from the elastic force of the valve spring and the inertial force generated by other valve system components.

If the engine speed of the engine is maintained within an engine speed range, the resistance force acts as a load in the positive direction relative to the centrifugal force of the weight during a prescribed period as the cam makes one rotation. During the other period, the resistance force described above acts as a load in the negative direction relative to the centrifugal force of the weight. Therefore, the state in which the centrifugal force acting on the weight and the biasing force of the coil spring are balanced cannot be maintained while the cam makes one rotation. In this case, the behavior of the weight becomes unstable.

As a result, the valve timing changes unstably, and the behavior of the valve becomes unstable, in other words, a phenomenon called hunting is caused.

Hunting gives rise to noises and degradation in the durability of the components. When the cam profile is changed by hunting, the performance and durability of the engine can be lowered in some cases.

SUMMARY OF THE INVENTION

In order to overcome the problems described above, preferred embodiments of the present invention provide a valve timing control device that can prevent hunting, and an engine device and a vehicle including the same.

A valve timing control device according to a preferred embodiment of the invention controls the opening/closing timings of first and second valves in response to the engine speed of an engine and includes a rotation member arranged to rotate in synchronization with the rotation of the engine, a first camshaft arranged to abut against the first valve and rotated together with the rotation member to open/close the first valve, a second camshaft arranged to abut against the second valve and rotatable relative to the first camshaft and rotated together with the rotation member to open/close the second valve, and a phase changing mechanism that changes the phase of the second camshaft relative to the first camshaft between first and second phases.

The phase changing mechanism preferably changes the phase of the second camshaft relative to the first camshaft from the first phase to the second phase at a first engine speed during an increase of the engine speed of the engine and from the second phase to the first phase at a second engine speed lower than the first engine speed during a decrease of the engine speed of the engine.

In the valve timing control device, the rotation member preferably rotates in synchronization with the rotation of the engine, and the first and second camshafts preferably rotate together with the rotation of the rotation member. In this way, the first valve in abutment against the first camshaft and the second valve in abutment against the second camshaft are opened/closed. In this case, the second camshaft is rotatable relative to the first camshaft.

During the increase of the engine speed of the engine, the phase of the second camshaft relative to the first camshaft is preferably changed from the first phase to the second phase by the phase changing mechanism at the first engine speed. In this state, the opening/closing timings of the first and second valves are controlled.

During the decrease of the engine speed of the engine, the phase of the second camshaft relative to the first camshaft is preferably changed from the second phase to the first phase by the phase changing mechanism at the second engine speed lower than the first engine speed. In this state, the opening/closing timings of the first and second valves are controlled.

In this way, the first engine speed during the increase of the engine speed of the engine and the second engine speed during the decrease of the engine speed of the engine are different, so that the phase of the second camshaft relative to the first camshaft is not repeatedly changed between the first phase and the second phase when the engine speed of the engine is maintained in the range of the first or second engine speed. Therefore, hunting that could cause the behavior of the first and second valves to be unstable can sufficiently be prevented.

The phase changing mechanism may include a first engaging mechanism arranged to engage the second camshaft while the second camshaft has the first phase relative to the first camshaft, and a second engaging mechanism arranged to engage the second camshaft while the second camshaft has the second phase relative to the first camshaft, the first engaging mechanism may be biased in a direction to engage the second camshaft and arranged to move in a direction to pull out the second camshaft by centrifugal force, and the second engaging mechanism may be biased in a direction to pull out the second camshaft and arranged to move in a direction to engage the second camshaft by centrifugal force.

In the phase changing mechanism, the first engaging mechanism is preferably biased in a direction to engage the second camshaft, and the second engaging mechanism is preferably biased in a direction to pull out the second camshaft.

The rotation of the rotation member allows centrifugal force to act on the first and second engaging mechanisms. The centrifugal force acts so that the first engaging mechanism pull outs the second camshaft and the second engaging mechanism engages the second camshaft.

When the engine operates at low engine speed, in the first engaging mechanism, the biasing force to engage the second camshaft is preferably larger than centrifugal force that acts to pull out the second camshaft. Therefore, the second camshaft is engaged by the first engaging mechanism. At that time, in the second engaging mechanism, the biasing force that acts in the direction to pull out the second camshaft is preferably larger than the centrifugal force that acts in the direction to engage the second camshaft. Therefore, the second camshaft is not engaged by the second engaging mechanism. Consequently, the second camshaft is engaged by the first engaging mechanism while it has the first phase relative to the first camshaft.

When the engine operates at high engine speed, in the first engaging mechanism, the biasing force that acts in the direction to engage the second camshaft is preferably smaller than the centrifugal force that acts in the direction to pull out the second camshaft. Therefore, the second camshaft is not engaged by the first engaging mechanism. At that time, in the second engaging mechanism, the biasing force that acts in the direction to pull out the second camshaft is preferably smaller than the centrifugal force that acts in the direction to engage the second camshaft. Therefore, the second camshaft is engaged by the second engaging mechanism. Consequently, the second camshaft is engaged by the second engaging mechanism while it has the second phase relative to the first camshaft.

In this way, as the engine speed changes from a low engine speed to a high engine speed or from a high engine speed to a low engine speed, the phase of the second camshaft relative to the first camshaft is changed between the first phase and the second phase. Therefore, the opening/closing timings of the first and second valves are controlled based on the engine speed of the engine.

The phase of the second camshaft relative to the first camshaft is switched without using frictional force between components but rather uses complementary movements between the first and second engaging mechanisms. Therefore, there is little degradation caused by abrasion between the components. As a result, the useful life of the valve timing control device can be prolonged without having to use wear resistant components, and the device can be manufactured less costly.

Furthermore, high working precision is not required, and the complementary movements between the first and second engaging mechanisms can be achieved simply by a mechanical arrangement, so that the device can be more readily manufactured. There is no need for a control system including a hydraulic circuit, an electric circuit, and software used to control the movements of the first and second engaging mechanisms. This allows the valve timing control device to have a reduced size.

The first engaging mechanism may include a first engaging portion provided at the second camshaft, a first engagement member arranged to move between the state of being engaged with the first engaging portion and the state of being pulled out from the first engaging portion, a first biasing member arranged to bias the first engagement member in a direction in which the first engagement member is to be engaged with the first engaging portion, and a first weight arranged to move the first engagement member in a direction in which the first engagement member is to be pulled out from the first engaging portion by centrifugal force, the second engaging mechanism may include a second engaging portion provided at the second camshaft, a second engagement member arranged to move between the state of being engaged with the second engaging portion and the state of being pulled out from the second engaging portion, a second biasing member that arranged to bias the second engagement member in a direction in which the second engagement member is to be pulled out from the second engaging portion, and a second weight arranged to move the second engagement member in a direction in which the second engagement member is to be engaged with the second engaging portion by centrifugal force, and the second camshaft may be arranged to rotate relative to the first camshaft between the first phase and the second phase while the first engagement member is pulled out from the first engaging portion and the second engagement member is pulled out from the second engaging portion.

When the engine operates at low engine speed, in the first engaging mechanism, the force of the first biasing member is preferably larger than the centrifugal force that acts on the first weight. In this way, the first engagement member is engaged with the first engaging portion, and the second camshaft is engaged by the first engaging mechanism. At that time, in the second engaging mechanism, the force of the second biasing member is preferably larger than the centrifugal force that acts on the second weight. Therefore, the second engagement member is pulled out from the second engaging portion, so that the second camshaft is not engaged by the second engaging mechanism. Consequently, the second camshaft is engaged by the first engaging mechanism while it has the first phase relative to the first camshaft.

When the engine operates at high engine speed, in the first engaging mechanism, the force of the first engaging mechanism is preferably smaller than the centrifugal force that acts on the first weight. In this way, the first engagement member is pulled out from the first engaging portion, so that the second camshaft is not engaged by the first engaging mechanism. At that time, in the second engaging mechanism, the force of the second biasing member is preferably smaller than the centrifugal force that acts on the second weight. Therefore, the second engagement member is inserted into the second engaging portion, so that the second camshaft is engaged by the second engaging mechanism. Consequently, the second camshaft is engaged by the second engaging mechanism while it has the second phase relative to the first camshaft.

When the engine speed of the engine is raised to the first engine speed, in the first engaging mechanism, the force of the first biasing member is preferably smaller than the centrifugal force that acts on the first weight. Therefore, the second camshaft that has been engaged by the first engaging mechanism is no longer engaged by the first engaging mechanism. In this way, the second camshaft rotates relative to the first camshaft from the first phase to the second phase.

When the engine speed of the engine is lowered to the second engine speed, in the second engaging mechanism, the force of the second biasing member is preferably larger than the centrifugal force that acts on the second weight. In this way, the second camshaft that has been engaged by the second engaging mechanism is no longer engaged by the second engaging mechanism. Consequently, the second camshaft rotates relative to the first camshaft from the second phase to the first phase.

In this way, using the first and second engaging portions, the first and second engagement members, the first and second biasing members, and the first and second weights, the complementary movements between the first and second engaging mechanisms are implemented with a simple arrangement.

The first engaging portion may include a first hole provided at the second camshaft, the first engagement member may include a first pin member arranged to move between the state of being inserted into the first hole and the state of being pulled out from the first hole, the second engaging portion may include a second hole provided at the second camshaft, and the second engagement member may be a second pin member arranged to move between the state of being inserted into the second hole and the state of being pulled out from the second hole.

When the engine operates at low engine speed, in the first engaging mechanism, the force of the first biasing member is preferably larger than the centrifugal force that acts on the first weight. In this way, the first pin member is inserted into the first hole, so that the second camshaft is engaged by the first engaging mechanism. At that time, in the second engaging mechanism, the force of the second biasing member is preferably larger than the centrifugal force that acts on the second weight. Therefore, the second pin member is pulled out from the second hole, so that the second camshaft is not engaged by the second engaging mechanism. Consequently, the second camshaft is engaged by the first engaging mechanism as it has the first phase relative to the first camshaft.

When the engine operates at high engine speed, in the first engaging mechanism, the force of the first biasing member is preferably smaller than the centrifugal force that acts on the first weight. In this way, the first pin member is pulled out from the first hole, so that the second camshaft is not engaged by the first engaging mechanism. At that time, in the second engaging mechanism, the force of the second biasing member is preferably smaller than the centrifugal force that acts on the second weight. Therefore, the second pin member is inserted into the second hole, so that the second camshaft is engaged by the second engaging mechanism. Consequently, the second camshaft is engaged by the second engaging mechanism as it has the second phase relative to the first camshaft.

When the engine speed is raised to the first engine speed, in the first engaging mechanism, the force of the first biasing member is preferably smaller than the centrifugal force that acts on the first weight. In this way, the second camshaft that has been engaged by the first engaging mechanism is no longer engaged by the first engaging mechanism. Therefore, the second camshaft rotates relative to the first camshaft from the first phase to the second phase.

When the engine speed is lowered to the second engine speed, in the second engaging mechanism, the force of the second biasing member is preferably larger than the centrifugal force that acts on the second weight. In this way, the second camshaft that has been engaged by the second engaging mechanism is no longer engaged by the second engaging mechanism. Therefore, the second camshaft rotates relative to the first camshaft from the second phase to the first phase.

In this way, using the first and second holes, the first and second pin members, the first and second biasing members, and the first and second weights, the complementary movements between the first and second engaging mechanisms are implemented with a simple arrangement.

The phase changing mechanism may further include a restricting mechanism arranged to restrict the rotation of the second camshaft relative to the first camshaft within the range between the first phase and the second phase.

When the engine speed is raised to the first engine speed, the second camshaft that has been engaged by the first engaging mechanism is no longer engaged by the first engaging mechanism. In this way, the second camshaft rotates relative to the first camshaft from the first phase to the second phase.

The rotation operation of the second camshaft relative to the first camshaft is restricted within the range between the first phase and the second phase by the restricting mechanism, so that the rotation of the second camshaft is surely stopped in the second phase. In this state, the second camshaft that has been engaged by the first engaging mechanism is engaged by the second engaging mechanism.

When the engine speed is lowered to the second engine speed, the second camshaft that has been engaged by the second engaging mechanism is no longer engaged by the second engaging mechanism. In this way, the second camshaft rotates relative to the first camshaft from the second phase to the first phase.

The rotation operation of the second camshaft relative to the first camshaft is restricted within the range between the first phase and the second phase by the restricting mechanism, so that the rotation of the second camshaft is surely stopped in the first phase. In this state, the second camshaft that has been engaged by the second engaging mechanism is engaged by the first engaging mechanism.

The restricting mechanism may include a preventing mechanism arranged to prevent the second camshaft from rotating when the phase of the second camshaft relative to the first camshaft changes from the first phase to the second phase and from the second phase to the first phase.

When the engine speed is raised to the first engine speed, the second camshaft preferably rotates relative to the first camshaft from the first phase to the second phase. In this case, the rotation operation of the second camshaft relative to the first camshaft is surely stopped in the second phase by the preventing mechanism.

When the engine speed is lowered to the second engine speed, the second camshaft preferably rotates relative to the first camshaft from the second phase to the first phase. In this case, the rotation of the second camshaft relative to the first camshaft is surely stopped in the first phase by the preventing mechanism.

In this way, the phase of the second camshaft relative to the first camshaft is readily and surely changed between the first and second phases.

The preventing mechanism may include a groove provided at the second camshaft in the circumferential direction, and an abutment member fixed to the rotation member and arranged so that the abutment member can move in the groove and abut against both end surfaces in the groove.

When the engine speed is raised to the first engine speed, the second camshaft preferably rotates relative to the first camshaft from the first phase to the second phase. In this case, the rotation of the second camshaft relative to the first camshaft is surely stopped in the second phase as the abutment member abuts against one end in the groove.

When the engine speed of the engine is lowered to the second engine speed, the second camshaft preferably rotates relative to the first camshaft from the second phase to the first phase. In this case, the rotation of the second camshaft relative to the first camshaft is surely stopped in the first phase as the abutment member abuts against the other end in the groove.

In this way, the phase of the second camshaft relative to the first camshaft is readily and surely changed between the first and second phases.

An engine device according to another preferred embodiment of the invention includes an engine having first and second valves, and a valve timing control device arranged to control the opening/closing timings of the first and second valves in response to the engine speed of the engine, the valve timing control device includes a rotation member arranged to rotate in synchronization with the rotation of the engine, a first camshaft arranged to abut against the first valve and rotated together with the rotation member to open/close the first valve, a second camshaft arranged to abut against the second valve and rotatable relative to the first camshaft and rotated together with the rotation member to open/close the second valve, and a phase changing mechanism arranged to change a phase of the second camshaft relative to the first camshaft between first and second phases, and the phase changing mechanism changes the phase of the second camshaft relative to the first camshaft from the first phase to the second phase at a first engine speed during an increase of the engine speed of the engine and from the second phase to the first phase at a second engine speed lower than the first engine speed during a decrease of the engine speed of the engine.

In the engine device, the opening/closing timings of the first and second valves are controlled in response to the engine speed of the engine by the valve timing control device.

In the valve timing control device, the rotation member preferably rotates in synchronization with the rotation of the engine, and the first and second camshafts preferably rotate together with the rotation of the rotation member. In this way, the first valve in abutment against the first camshaft and the second valve in abutment against the second camshaft are opened/closed. The second camshaft is rotatable relative to the first camshaft.

During the increase of the engine speed of the engine, the phase of the second camshaft relative to the first camshaft is changed from the first phase to the second phase at the first engine speed by the phase changing mechanism. In this state, the opening/closing timings of the first and second valves are controlled.

During the decrease of the engine speed of the engine, the phase of the second camshaft relative to the first camshaft is changed from the second phase to the first phase at the second engine speed lower than the first engine speed by the phase changing mechanism. In this state, the opening/closing timings of the first and second valves are controlled.

In this way, the first engine speed during the increase of the engine speed of the engine and the second engine speed during the decrease of the engine speed of the engine are different, so that the phase of the second camshaft relative to the first camshaft is not repeatedly changed between the first phase and the second phase when the engine speed of the engine is maintained in the range of the first or second engine speed. Therefore, hunting that could cause the behavior of the first and second valves to be unstable can sufficiently be prevented. Therefore, an engine device in which hunting is sufficiently prevented can be provided.

A vehicle according to yet another preferred embodiment of the invention includes an engine device, driving wheels, and a transmission mechanism that transmits power generated by the engine device to the driving wheels, the engine device include an engine having first and second valves, and a valve timing control device arranged to control the opening/closing timings of the first and second valves in response to the engine speed of the engine, the valve timing control device includes a rotation member arranged to rotate in synchronization with the rotation of the engine, a first camshaft arranged to abut against the first valve and rotated together with the rotation member to open/close the first valve, a second camshaft arranged to abut against the second valve and rotate relative to the first camshaft and rotated together with the rotation member to open/close the second valve, and a phase changing mechanism arranged to change the phase of the second camshaft relative to the first camshaft between first and second phases, the phase changing mechanism changes the phase of the second camshaft relative to the first camshaft from the first phase to the second phase at a first engine speed during the increase of the engine speed of the engine and from the second phase to the first phase at a second engine speed lower than the first engine speed during the decrease of the engine speed of the engine.

In the vehicle, the power generated by the engine device is transmitted to the driving wheels by the transmission mechanism and the driving wheels are driven accordingly. In the engine device, the opening/closing timings of the first and second valves are controlled in response to the engine speed of the engine by the valve timing control device.

In this case, in the valve timing control device of the engine device, the first engine speed during the increase of the engine speed of the engine and the second engine speed during the decrease of the engine speed of the engine are different, so that the phase of the second camshaft relative to the first camshaft is not repeatedly changed between the first phase and the second phase when the engine speed of the engine is maintained in the range of the first or second engine speed. Therefore, hunting that could cause the behavior of the first and second valves to be unstable can sufficiently be prevented. Therefore, a vehicle in which hunting is sufficiently prevented can be provided.

In the valve timing control device according to the preferred embodiments of the present invention, the first engine speed during the increase of the engine speed of the engine and the second engine speed during the decrease of the engine speed of the engine are different, so that the phase of the second camshaft relative to the first camshaft is not repeatedly changed between the first phase and the second phase when the engine speed of the engine is maintained in the range of the first or second engine speed. Therefore, hunting that could cause the behavior of the first and second valves to be unstable can sufficiently be prevented. Therefore, an engine device and a vehicle in which hunting is sufficiently prevented can be provided.

The foregoing and other elements, features, steps, characteristics aspects, and advantages of the present invention will become more apparent from the following detailed description of preferred embodiments the present invention when taken in conjunction with the accompanying drawings.

DETAILED DESCRIPTION OF PREFERRED EMBODIMENTS

Now, a valve timing control device according to preferred embodiments of the present invention and an engine device and a vehicle including the control device will be described. In the following, a small size motorcycle having a displacement of about 250 cc or less will be described as an example of a preferred embodiment of the present invention, although the present invention is in no way limited thereto.

Figure 1:
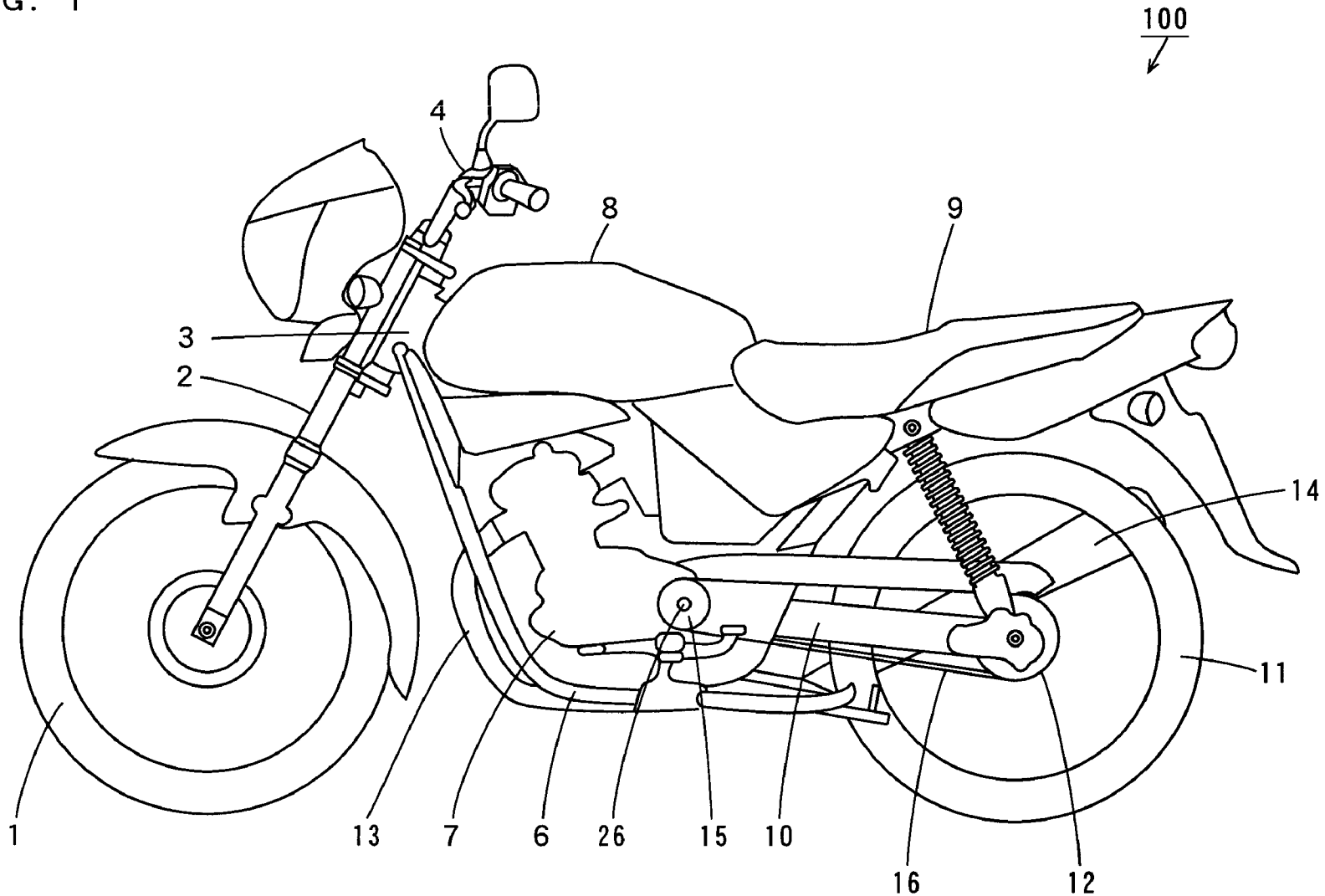
FIG. 1 is a schematic view of a motorcycle according to a preferred embodiment of the invention.

FIG. 1 is a schematic view of the motorcycle according to a preferred embodiment of the invention.

In the motorcycle 100, a head pipe 3 is provided at the front end of a main body frame 6. A front fork 2 provided at the head pipe 3 can swing from side to side. At the lower end of the front fork 2, a front wheel 1 is rotatably supported. A handle 4 is attached to the upper end of the head pipe 3.

An engine 7 is held in the center of the main body frame 6. A fuel tank 8 is provided above the engine 7, and a seat 9 is provided behind the fuel tank 8.

A rear arm 10 is connected to the main body frame 6 to extend behind the engine 7. The rear arm 10 holds the rear wheel 11 and a rear wheel driven sprocket 12 in a rotatable manner. An exhaust pipe 13 is connected to the exhaust port of the engine 7. A muffler 14 is attached to the rear end of the exhaust pipe 13.

A rear wheel drive sprocket 15 is attached to the drive shaft 26 of the engine 7. The rear wheel drive sprocket 15 is coupled to the rear wheel driven sprocket 12 of the rear wheel 11 through a chain 16.

The engine 7 includes a valve timing control device. Now, the valve timing control device according to a preferred embodiment will be described.

Figure 2B:
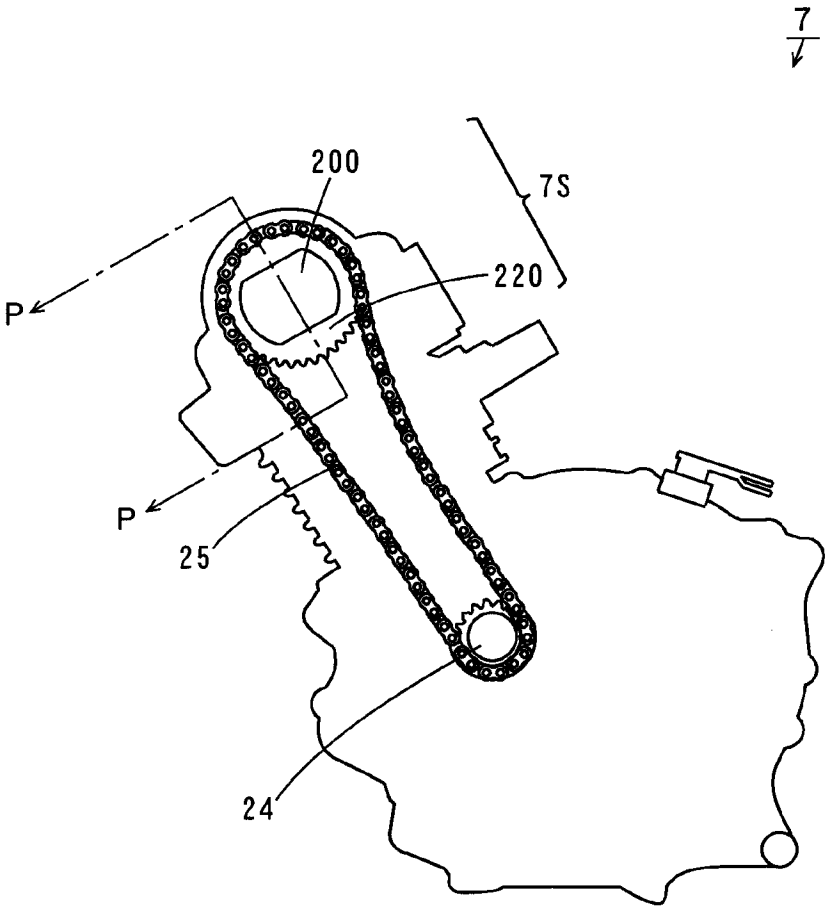
FIGS. 2(*a*) and 2(*b*) are views for use in illustrating the general structure of a valve timing control device according to a preferred embodiment of the present invention.
Figure 2A:
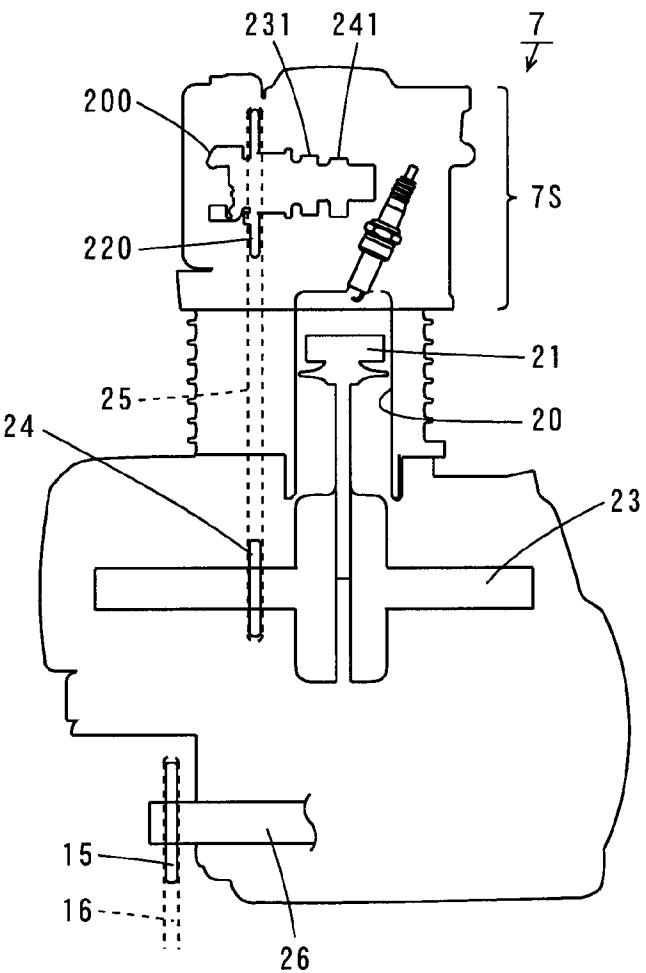

FIGS. 2(*a*) and 2(*b*) illustrate the general structure of the valve timing control device according to a preferred embodiment of the invention. FIG. 2(*a*) is a schematic top view of the valve timing control device provided in the engine 7. FIG. 2(*b*) is a schematic side view of the valve timing control device provided in the engine 7.

As shown in FIG. 2(*a*), the valve timing control device 200 is provided at a cylinder head 7S. The valve timing control device 200 includes a cam driven sprocket 220, an intake cam 231, and an exhaust cam 241.

As a piston 21 reciprocates in the cylinder 20, a crankshaft 23 rotates, and the cam drive sprocket 24 provided at the crankshaft 23 rotates.

The turning force of the cam drive sprocket 24 is transmitted to the cam driven sprocket 220 of the valve timing control device 200 through a chain 25. In this way, the valve timing control device 200 rotates.

In the valve timing control device 200, the phase relation between the intake cam 231 and the exhaust cam 241 changes in response to the engine speed of the engine 7 and changes in the engine speed (increase and decrease in the engine speed). This changes the valve timing.

Figure 3:
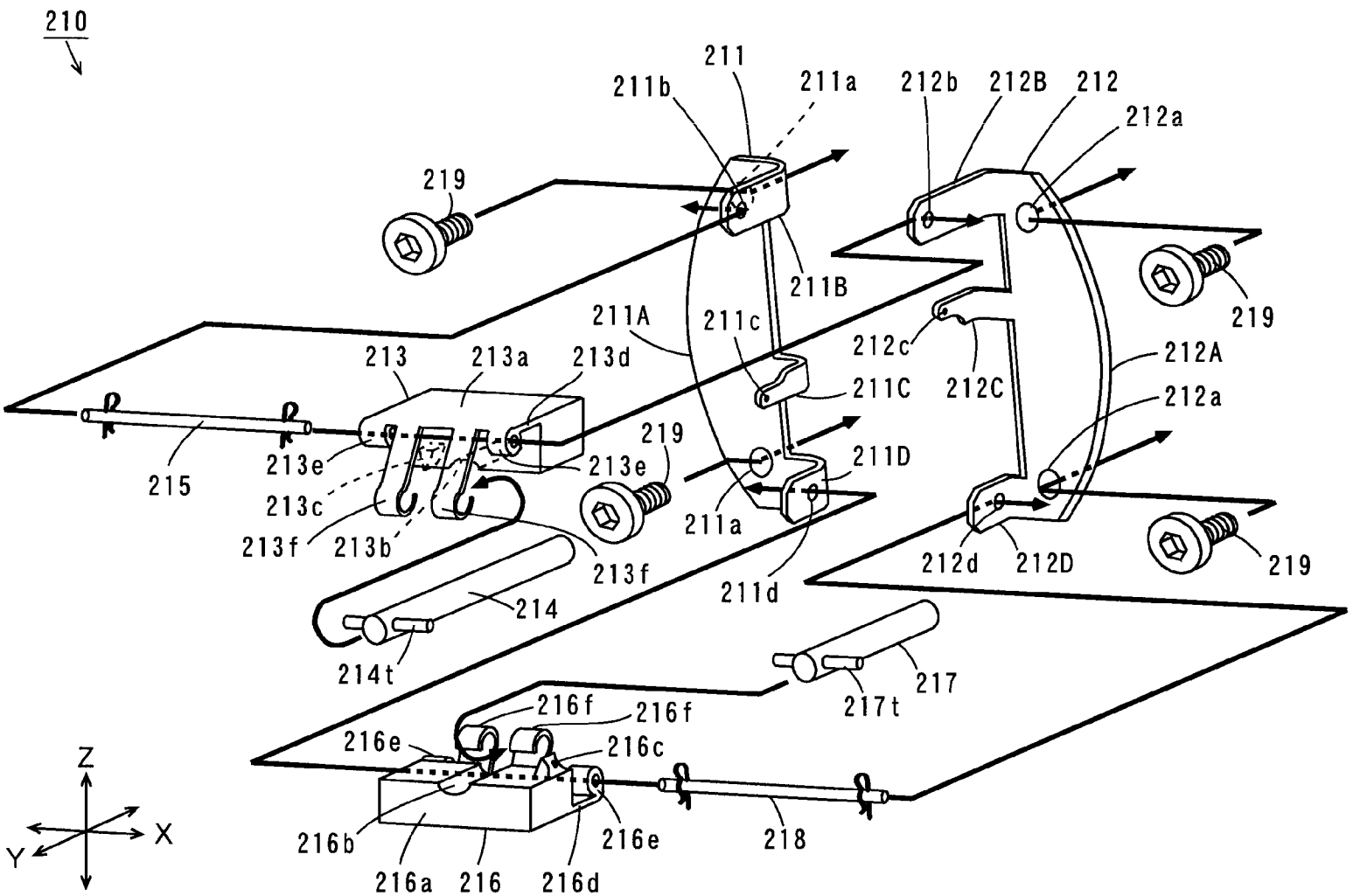
FIG. 3 is a perspective view for use in illustrating how a valve timing control device is assembled.
Figure 4:
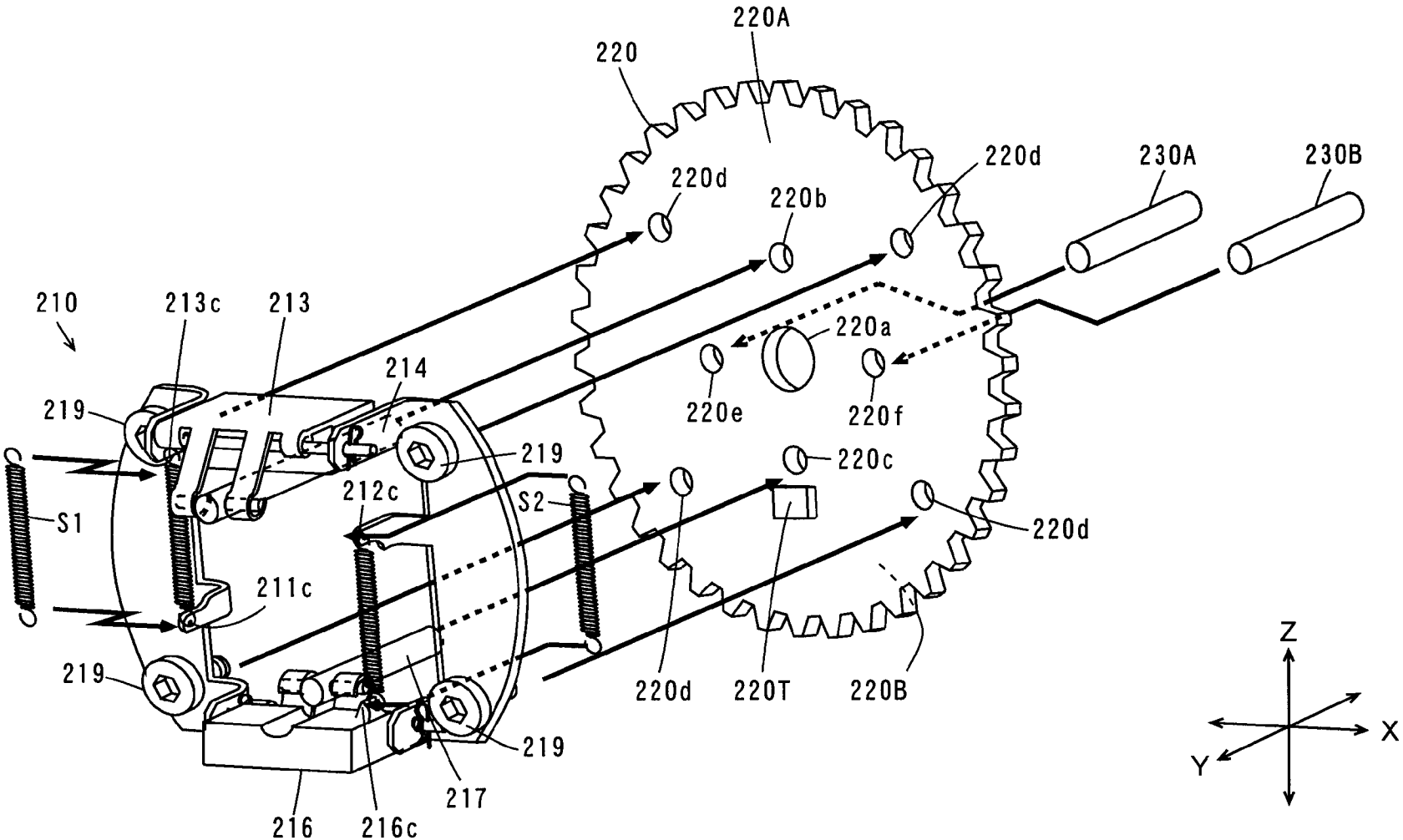
FIG. 4 is a perspective view for use in illustrating how a valve timing control device is assembled.
Figure 5:
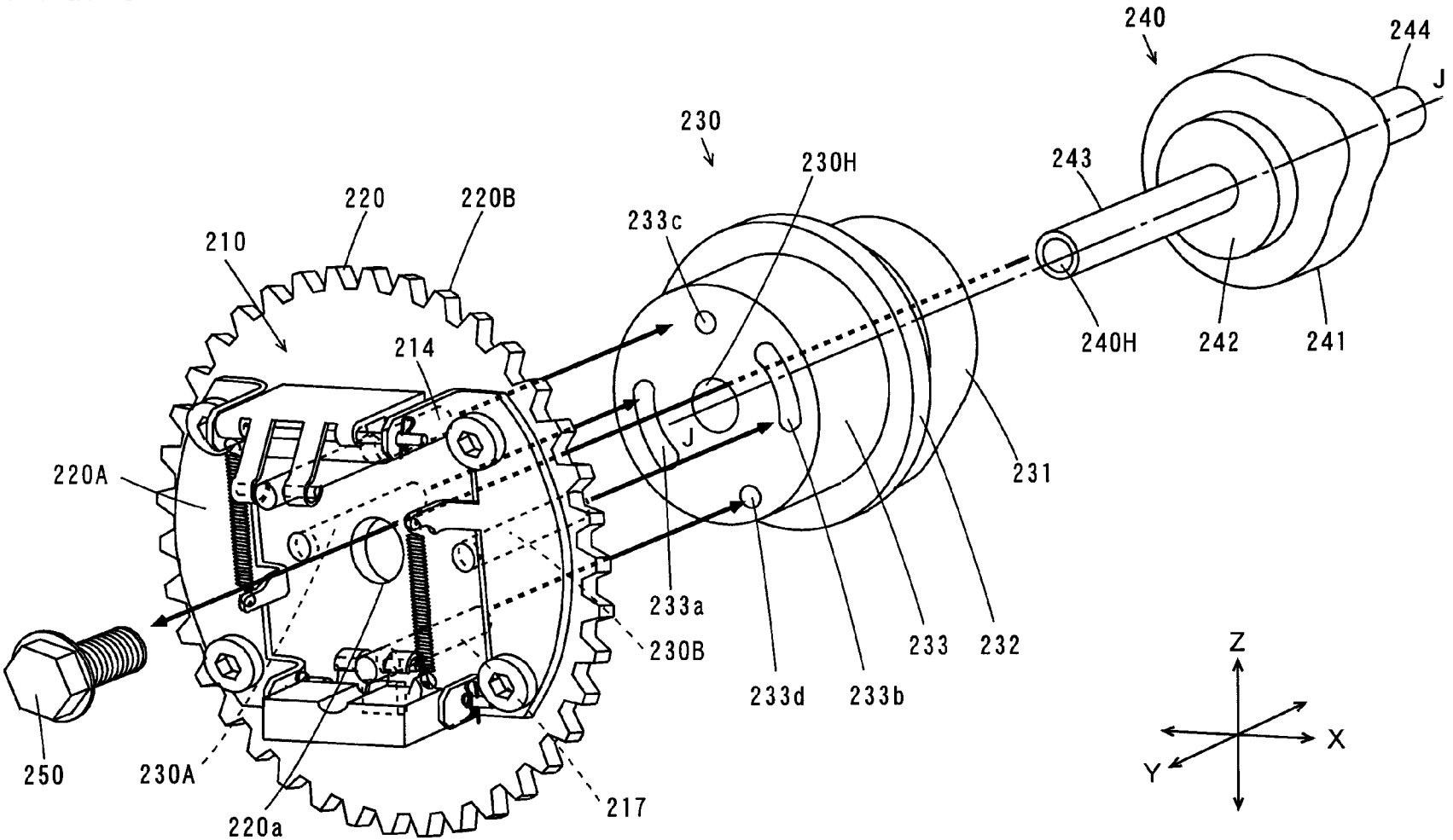
FIG. 5 is a perspective view for use in illustrating how a valve timing control device is assembled.

The structure and operation of the valve timing control device 200 will be described in detail. FIGS. 3 to 5 are perspective views for use in illustrating how the valve timing control device 200 is assembled. In FIGS. 3 to 5, the three directions that are perpendicular to substantially perpendicular to one another as indicated by arrows X, Y, and Z are defined as the X-, Y-, and Z-directions, respectively.

The valve timing control device 200 mainly includes a lock pin holding mechanism 210 (see FIG. 3), a cam driven sprocket 220 (see FIG. 4), an intake camshaft 230 (see FIG. 5), and an exhaust camshaft 240 (see FIG. 5).

FIG. 3 is a perspective view showing how the lock pin holding mechanism 210 is assembled. As shown in FIG. 3, two support members 211 and 212 elongated in the Z-direction are provided a prescribed distance apart from each other in the X-direction.

The support member 211 has a substantially circular arc shaped, plate portion 211A that is parallel or substantially parallel to the X-Z plane and elongated in the Z-direction. One side of the plate portion 211A in the Z-direction has a circular arc shape, and the other side has a linear shape. A through hole 211*a* is formed in the vicinity of each of the upper and lower end portions of the plate portion 211A.

Projections 211B and 211D are arranged to extend in the Y-direction from the upper and lower ends of one side along the Z-direction of the plate portion 211A. A spring holding member 211C is arranged to extend in the X-direction from the part below the center of the side of the plate portion 211A along the Z-direction and then bent in the Y-direction.

The projections 211B and 211D and the spring holding member 211C have through holes 211*b*, 211*d*, and 211*c*, respectively. In the Y-direction, the projection 211B is the shortest, the spring holding member 211C is the second shortest, and the projection 211D is the third shortest among these three. In this way, in the Y-direction, the through holes 211*b*, 211*c*, and 211*d* are closer to the plate portion 211A in this order.

The support members 212 and 211 are substantially symmetrical with respect to the X-Z plane. Projections 212B and 212D are formed to extend in the Y-direction from the upper and lower ends of one side along the Z-direction of the plate portion 212A.

The through holes 212*a* are formed in the vicinity of the upper and lower ends of the plate portion 212A. A spring holding member 212C is arranged to extend from the position above the center of the side along the Z-direction of the plate portion 212A. The spring holding member 212C is formed to extend in the Z-direction and then bent in the Y-direction. The projections 212B and 212D and the spring holding member 212C have through holes 212*b*, 212*d*, and 212*c*, respectively.

Note that the lengths of the projections 212B and 212D of the support member 212 in the Y-direction are equal to the projections 211B and 211D of the support member 211 in the Y-direction. The length of the spring holding member 212C of the support member 212 in the Y-direction is different from the length of the spring holding member 211C of the support member 211 in the Y-direction.

A weight 213 has a weight main body 213*a*, a plate shaped extension 213*d*, two tubular portions 213*e*, and two hook portions 213*f*. The weight main body 213*a* has a substantially rectangular shape extending in the X-direction. One surface (lower surface) of the weight main body 213*a* that is parallel or substantially parallel to the X-Y plane has a groove 213*b* along the Y-direction and a projection 213*c* projecting in the Z-direction. The projection 213*c* has a through hole extending in the X-direction.

The extension 213*d* extends in the Y-direction from the other surface (upper surface) of the weight main body 213*a* that is parallel or substantially parallel to the X-Y plane. The two tubular portions 213*e* are formed in the X-direction on both ends of the extension 213*d* in the X-direction.

The two hook portions 213*f* extend to be inclined from the center of the extension 213*d* in the X-direction to the lower side of the extension 213*d*. The two hook portions 213*f* have their tip ends bent like hooks.

The two hook portions 213*f* are provided with high speed lock pin 214 that extends in the Y-direction. At one end of the high speed lock pin 214, a support pin 214*t* extending in the X-direction is formed. Since the support pin 214*t* is provided at the hook portion 213*f*, the high speed lock pin 214 is pivotably held by the weight 213. Part of the high speed lock pin 214 can abut against the groove 213*b*.

A pivot shaft 215 is inserted into the tubular portions 213*e* of the weight 213. In this way, the pivot shaft 215 can hold the weight 213 in a pivotable manner. In this state, both ends of the pivot shaft 215 are inserted into the through holes 211*b* and 212*b* of the support members 211 and 212, respectively. In this way, the weight 213 is pivotably held between the support members 211 and 212.

A weight 216 preferably has the same structure as the weight 213. However, during assembling the lock pin holding mechanism 210, the weight 216 is arranged symmetrically to the weight 213 with reference to an axis that is parallel or substantially parallel to the X-direction.

In FIG. 3, the weight main body 216*a*, an extension 216*d*, two tubular portions 216*e* and two hook portions 216*f* of the weight 216 correspond to the weight main body 213*a*, the extension 213*d*, the two tubular portions 213*e* and the two hook portions 213*f* of the weight 213, respectively.

The groove 216*b* and the projection 216*c* of the weight 216 correspond to the groove 213*b* and the projection 213*c* of the weight 213, respectively.

The two hook portions 216*f* are provided with a low speed lock pin 217 extending in the Y-direction. The low speed lock pin 217 is shorter than the high speed lock pin 214. A support pin 217*t* is formed to extend in the X-direction at one end of the low speed lock pin 217. Since the support pin 217*t* is provided at the hook portion 216*f*, the low speed lock pin 217 is pivotably held by the weight 216. The low speed lock pin 217 has its pivotable range restricted as will be described. In this way, the low speed lock pin 217 does not abut against the groove 216*b*.

A pivot shaft 218 is inserted into the tubular portions 216*e* of the weight 216. In this way, the pivot shaft 218 can hold the weight 216 in a pivotable manner. In this state, both ends of the pivot shaft 218 are inserted into the through holes 211*d* and 212*d* of the support members 211 and 212. In this way, the weight 216 is held pivotably between the support members 211 and 212.

In this way, the weights 213 and 216 are arranged to oppose each other in the Z-direction.

Screws 219 are inserted into the two through holes 211*a* of the support member 211 and the two through holes 212*a* of the support members 212.

FIG. 4 is a perspective view showing how the lock pin holding mechanism 210 and the cam driven sprocket 220 are assembled. When the lock pin holding mechanism 210 and the cam driven sprocket 220 are assembled, the cam driven sprocket 220 is arranged parallel or substantially parallel to the X-Z plane.

Note that in FIG. 4, in the lock pin holding mechanism 210, a spring S1 has its both ends attached in a through hole provided at the projection 213*c* of the weight 213 and the through hole 211*c* of the spring holding portion 211C. In the lock pin holding mechanism 210, a spring S2 has its both ends attached in a through hole provided at the projection 216*c* of the weight 216 and the through hole 212*c* of the spring holding member 212C.

As shown in FIG. 4, the cam driven sprocket 220 has a plurality of through holes 220*a* to 220*f*. In the center of the cam driven sprocket 220, a through hole 220*a* having the largest diameter among all the through holes is formed.

The four through holes 220*b*, 220*c*, 220*e*, and 220*f* are preferably formed at substantially equiangular intervals on a circle centered around the through hole 220*a* of the cam driven sprocket 220. The four through holes 220*d* are preferably formed at substantially equiangular intervals on another circle around the through hole 220*a* of the cam driven sprocket 220. The four through holes 220*d* are each formed by thread cutting.

A projection 220T is formed in the vicinity of the through hole 220*c* at one surface 220A of the cam driven sprocket 220.

The screws 219 of the lock pin holding mechanism 210 are screwed in the four through holes 220*d* of the cam driven sprocket 220. In this way, the lock pin holding mechanism 210 is fixed to the side of the surface 220A of the cam driven sprocket 220.

When the lock pin holding mechanism 210 is fixed to the cam driven sprocket 220, the high speed lock pin 214 is inserted in the through hole 220*b*, and the low speed lock pin 217 is inserted in the through hole 220*c*. As described in conjunction with FIG. 3, the high speed lock pin 214 does not project to the side of the other surface 220B of the cam driven sprocket 220 and the low speed lock pin 217 projects a prescribed length from the side of the other surface 220B of the cam driven sprocket 220.

On the side of the other surface 220B of the cam driven sprocket 220, ends of two fixing pins 230A and 230B extending in the Y-direction are inserted in the trough holes 220*e* and 220*f*, respectively and fixed.

FIG. 5 is a perspective view of the structure assembled as shown in FIG. 4 (hereinafter referred to as "assembled structure") and the assembly of the intake camshaft 230 and the exhaust camshaft 240. Note that the intake camshaft 230 and the exhaust camshaft 240 have their axial center J arranged parallel or substantially parallel to the Y-direction.

As shown in FIG. 5, the intake camshaft 230 includes an intake cam 231, a stepped portion 232, and a pivot shaft 233.

In the Y-direction, the intake camshaft 230 has the cylindrical pivot shaft 233 on one end side, the stepped portion 232 having a diameter slightly greater than the diameter of the pivot shaft 233 in the center, and the intake cam 231 on the other end side.

A pivot through hole 230H is formed to extend in the Y-direction from the center of the end of the pivot shaft 233 to the center of the end of the intake cam 231. More specifically, the pivot through hole 230H is formed from one end to the other end of the intake camshaft 230 in the Y-direction.

On the end surface of the pivot shaft 233, a high speed pin introduction hole 233*c*, a low speed pin introduction hole 233*d*, two grooves 233*a* and 233*b* for floating a pin are formed on a circle around the axial center J.

The high speed pin introduction hole 233*c* and the low speed pin introduction hole 233*d* are formed substantially opposing to each other across the pivot through hole 230H. Note however that the high speed pin introduction hole 233*c* and the low speed pin introduction hole 233*d* are arranged so that a straight line connecting each other does not pass through the axial center J.

The grooves 233*a* and 233*b* for floating a pin are formed to extend in the circumferential direction around the axial center J and oppose to each other across the pivot through hole 230H.

The exhaust camshaft 240 has an exhaust cam 241, a stepped portion 242, a cam fixing shaft 243, and a projection shaft 244.

The exhaust camshaft 240 has the cam fixing shaft 243 extending in the Y-direction on one end side in the Y-direction, the stepped portion 242 and the exhaust cam 241 in the center, and the projection shaft 244 extending in the Y-direction on the other end side. A sprocket screw hole 240H is formed at an end of the cam fixing shaft 243.

When the assembled structure, the intake camshaft 230, and the exhaust camshaft 240 are assembled, the intake camshaft 230 and the exhaust camshaft 240 are provided on the side of the other surface 220B of the cam driven sprocket 220.

More specifically, the cam fixing shaft 243 of the exhaust camshaft 240 is inserted in the pivot through hole 230H of the intake camshaft 230. In this way, the exhaust camshaft 240 holds the intake camshaft 230 in a rotatable manner. One end of the cam fixing shaft 243 of the exhaust camshaft 240 is inserted in the through hole 220*a* from the other side of the surface 220B of the cam driven sprocket 220.

In this state, a sprocket screw 250 is screwed in the sprocket screw hole 240H of the cam fixing shaft 243 from the side of the surface 220A of the cam driven sprocket 220. In this way, the cam driven sprocket 220 is fixed to the exhaust camshaft 240.

Note that the exhaust cam 241, the stepped portion 242, the cam fixing shaft 243, and the projection shaft 244 of the exhaust camshaft 240 may be formed either integrally or discretely. The intake cam 231, the stepped portion 232, and the pivot shaft 233 of the intake camshaft 230 may be formed either integrally or discretely.

Although not shown in FIG. 5, a fixing mechanism that restricts the rotation of the exhaust camshaft 240 relative to the cam driven sprocket 220 may be provided at the connecting part of the cam fixing shaft 243 and the through hole 220*a*.

The fixing mechanism may be implemented for example by providing a projection portion at a tip end of the cam fixing shaft 243 of the exhaust camshaft 240 and providing a groove that can be engaged with the projection portion of the cam fixing shaft 243 at the through hole 220*a* of the cam driven sprocket 220.

Meanwhile, during the assembling operation described above, the intake camshaft 230 is positioned as it is held by the exhaust camshaft 240 as follows.

The fixing pins 230A and 230B and a portion of the low speed lock pin 217 project in the Y-direction from the side of the other surface 220B of the cam driven sprocket 220. The intake camshaft 230 is positioned such that the fixing pin 230A is inserted into the groove 233*a* for floating a pin, the fixing pin 230B is inserted in the groove 233*b* for floating a pin, and a portion of the low speed lock pin 217 is inserted into the low speed pin introduction hole 233*d*.

In this way, at the end of assembling operation, the pivotal movement of the intake camshaft 230 is restricted by the low speed lock pin 217 and the low speed pin introduction hole 233*d*. Consequently, the intake camshaft 230 and the exhaust camshaft 240 are fixed to the cam driven sprocket 220 so that they cannot pivot.

How the valve timing control device 200 as described above is attached to the engine 7 will now be described.

Figure 6:
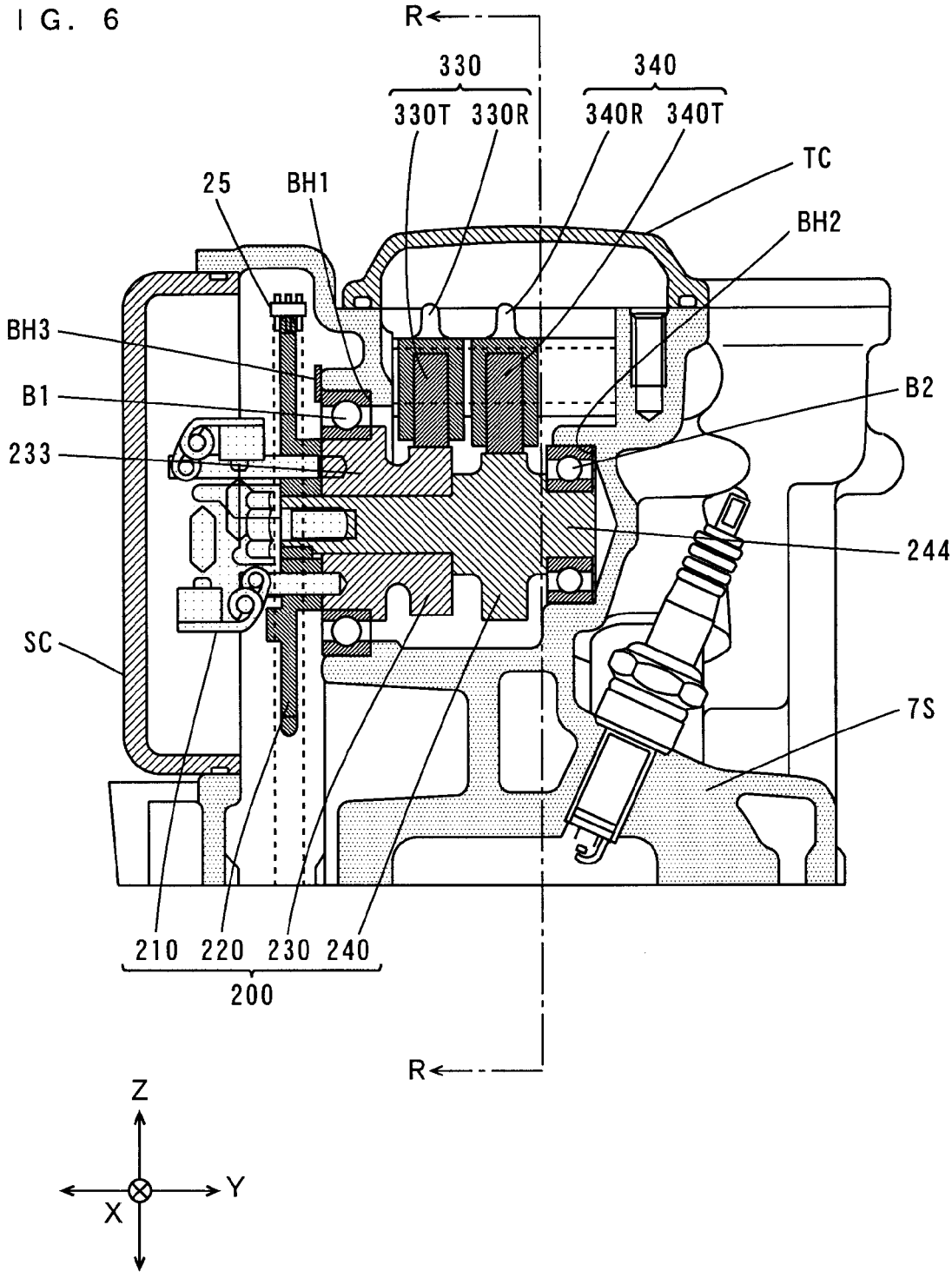
FIG. 6 is a detailed sectional view of a cylinder head taken along line P-P in FIG. 2(*b*).

FIG. 6 is a detailed sectional view of a cylinder head 7S taken along line P-P in FIG. 2(*b*). In FIG. 6, the three directions that are perpendicular or substantially perpendicular to one another as indicated by X, Y, and Z are defined as the X-, Y-, and Z-directions, respectively. Note that in FIGS. 7 and 8, the X-, Y-, and Z-directions are defined in the same manner.

As shown in FIG. 6, there is a space for attaching the valve timing control device 200 in the center of the cylinder head 7S.

When the valve head timing control device 200 is attached to the cylinder head 7S, bearings B1 and B2 are attached to the pivot shaft 233 and the projection shaft 244 of the valve timing control device 200.

In the cylinder head 7S, one end surface of the bearing B1 that is perpendicular or substantially perpendicular to the axis in the Y-direction abuts against the inner abutment surface BH1 of the cylinder head 7S. One end surface of the bearing B2 that is perpendicular or substantially perpendicular to the axis in the Y-direction abuts against the inner abutment surface BH2 of the cylinder head 7S.

As the valve timing control device 200 is accommodated in the cylinder head 7S, a portion of the other end surface of the bearing B1 that is perpendicular or substantially perpendicular to the axis in the Y-direction abuts against a fixing plate BH3 connected to the cylinder head 7S. In this way, the valve timing control device 200 is pivotably fixed in the cylinder head 7S.

Two roller rocker arms 330 and 340 are provided above the valve timing control device 200. The roller rocker arm 330 is provided above the intake camshaft 230, and a roller 330T attached to the arm 330R abuts against the intake camshaft 230.

The roller rocker arm 340 is provided above the exhaust camshaft 240, and a roller 340T attached to the arm 340R abuts against the exhaust camshaft 240. A side cover SC is provided to the cylinder head 7S to cover the side of the lock pin holding mechanism 210 of the valve timing control device 200.

Figure 7:
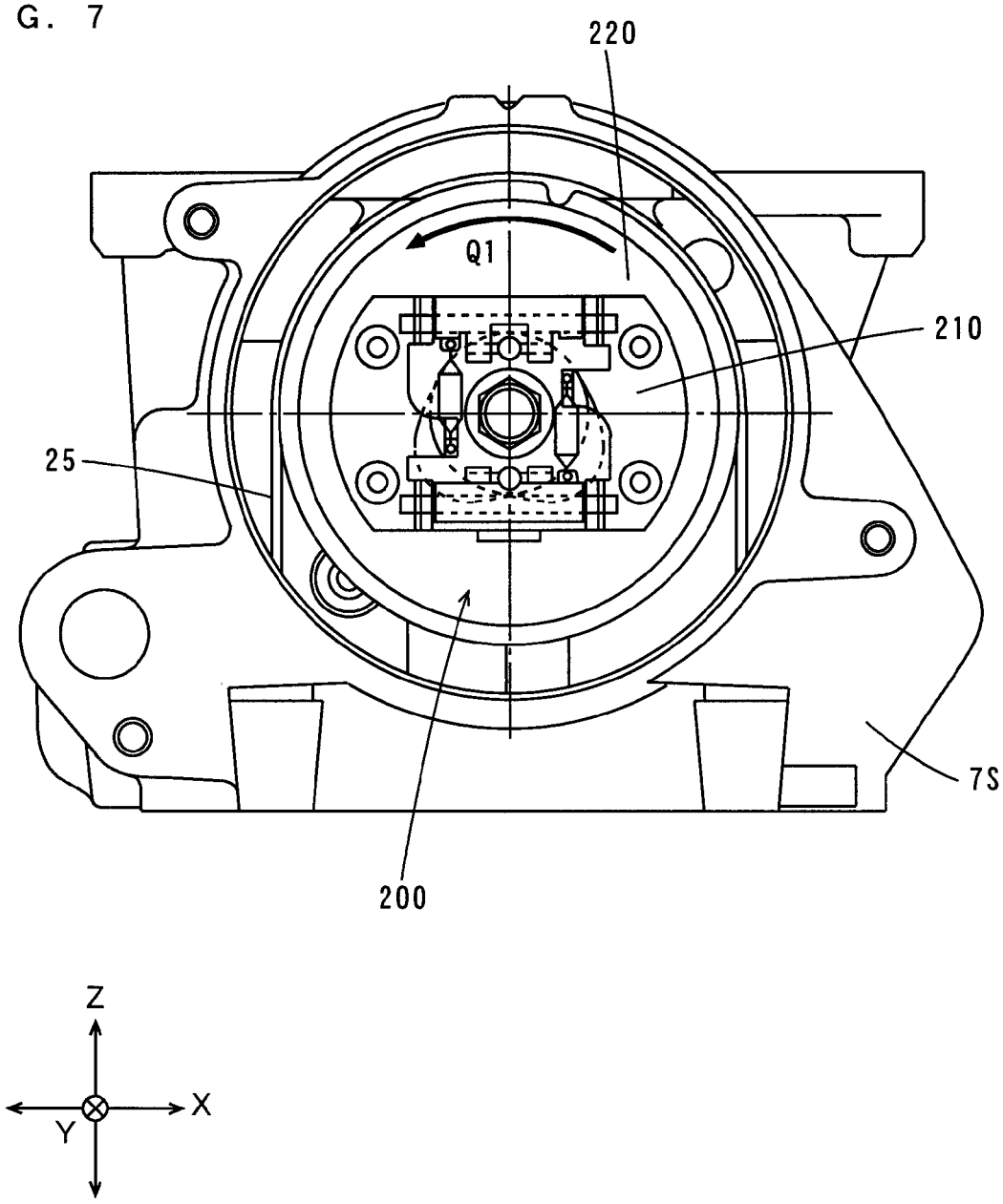
FIG. 7 is an external side view of the cylinder head with of the side cover in FIG. 6 removed.

FIG. 7 is an external side view of the cylinder head 7S with the side cover SC in FIG. 6 removed. As shown in FIG. 7, the chain 25 is engaged with the cam driven sprocket 220. In FIG. 7, the valve timing control device 200 rotates in the direction denoted by the arrow Q1.

Figure 8A:
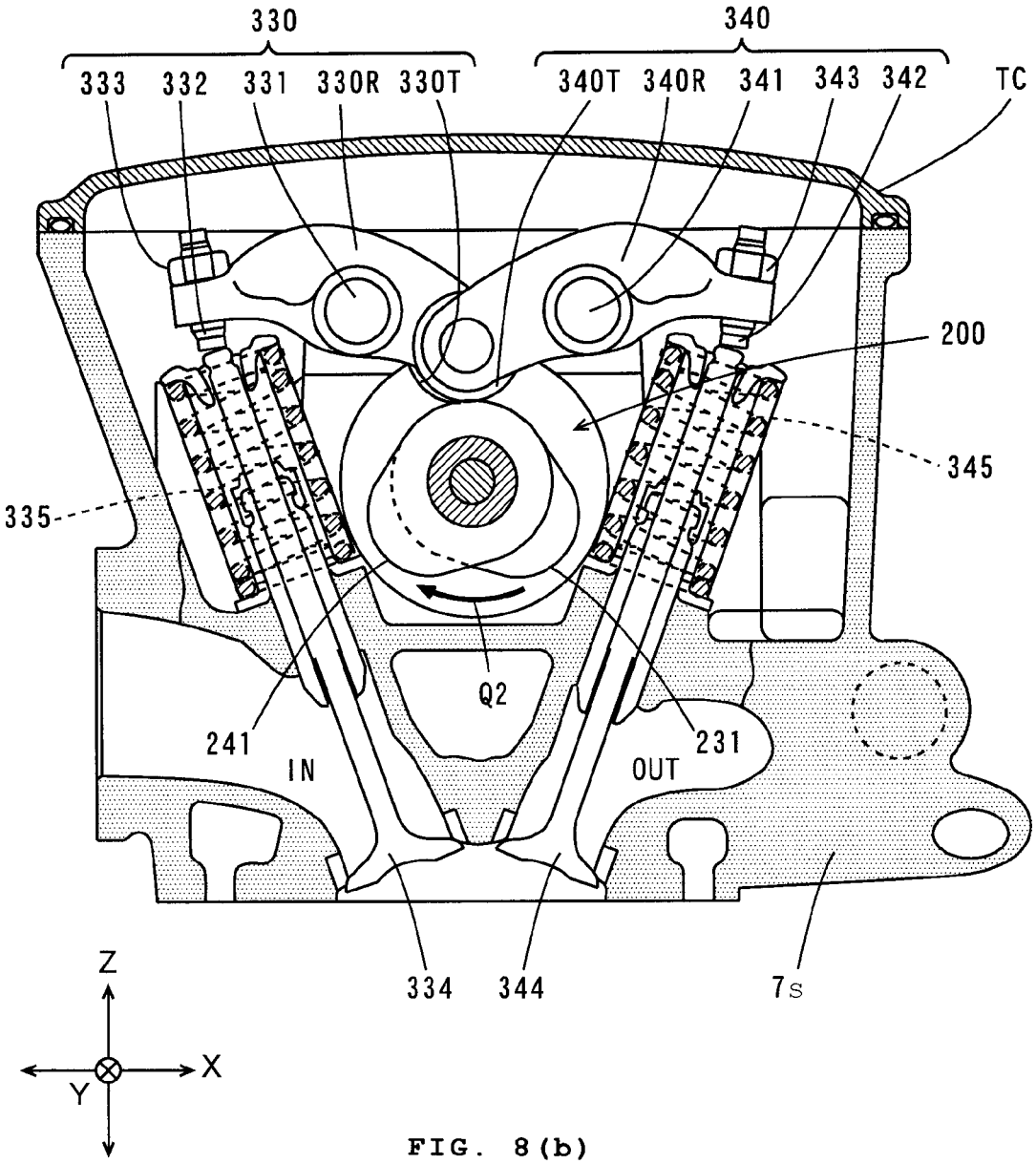
FIG. 8(*a*) includes a partly cutaway sectional view of the cylinder head taken along line R-R in FIG. 6 and FIG. 8(*b*) includes a view for use in illustrating the phase relation between an intake cam and an exhaust cam.
Figure 8B:
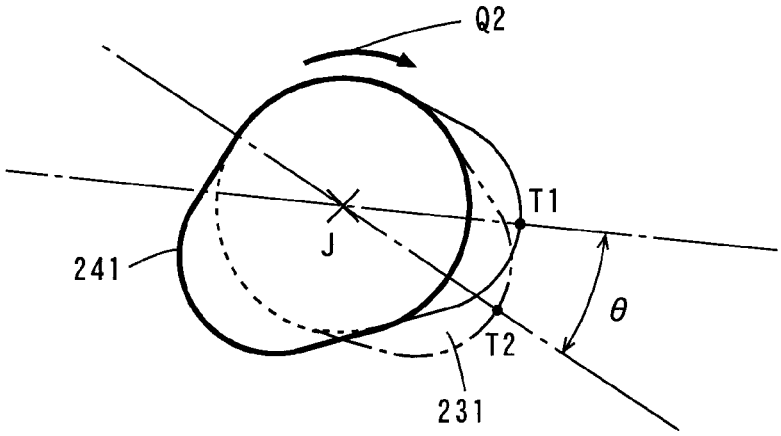

FIG. 8(*a*) shows a partly cutaway sectional view of the cylinder head 7S taken along line R-R in FIG. 6, and FIG. 8(*b*) shows a view for use in illustrating the phase relation between the intake cam 231 and the exhaust cam 241.

FIG. 8(*a*) is a partly cutaway sectional view of the cylinder head 7S taken along line R-R in FIG. 6. In FIG. 8(*a*), the section is partly removed around the intake valve and the exhaust valve for the ease of understanding.

As shown in FIG. 8(*a*), the roller rocker arm 330 provided above the intake cam 231 includes the roller 330T, the arm 330R, a shaft 331, an adjuster 332, and a nut 333.

The arm 330R extending in the X-direction is pivotably held by the shaft 331 in its central part. The roller 330T is provided at one end of the arm 330R in the X-direction, and the adjuster 332 is attached at the other end by the nut 333.

The roller 330T moves up and down according to the rotation operation of the intake cam 231. In this way, the arm 330R pivots around the shaft 331. Then, the adjuster 332 attached to the other end of the arm 330R moves up and down.

The upper end of the intake valve 334 is positioned at the lower end of the adjuster 332. A valve spring 335 is provided at the intake valve 334, and the valve spring 335 biases the upper end of the intake valve 334 in the upward direction.

In this state, as the adjuster 332 moves up and down, the intake valve 334 also moves up and down. This allows the intake valve 334 to be opened/closed.

In this way, the rotation force of the intake cam 231 is transmitted to the intake valve 334 through the roller rocker arm 330. Meanwhile, the elastic force of the valve spring 335 is transmitted to the intake cam 231 through the roller rocker arm 330.

The roller rocker arm 340 provided above the exhaust cam 241 has the same structure as the roller rocker arm 330 and operates in the same manner. The roller 340T, an arm 340R, a shaft 341, an adjuster 342, and a nut 343 of the roller rocker arm 340 correspond to the roller 330T, the arm 330R, the shaft 331, the adjuster 332, and the nut 333, respectively, of the roller rocker arm 330. The exhaust valve 344 is provided with a valve spring 345.

Note that in FIG. 8(*a*), the valve timing control device 200 rotates in the direction denoted by the arrow Q2.

According to the present preferred embodiment, the phase of the intake cam 231 relative to the phase of the exhaust cam 241 varies depending on the structure of the above-described valve timing control device 200.

FIG. 8(*b*) is a view for use in illustrating the phase relation between the intake cam 231 and the exhaust cam 241. For ease of understanding, the exhaust cam 241 is shown by a thick solid line in FIG. 8(*b*). The intake cam 231 is shown by a thin solid line and a two dot chain line.

As denoted by the solid line in FIG. 8(*b*), when the engine 7 operates at low engine speed, the tip end of the cam nose of the intake cam 231 is at position T1. When the engine speed of the engine 7 is raised from this state and exceeds a prescribed engine speed, the tip end of the cam nose of the intake cam 231 moves to position T2. Hereinafter, the prescribed engine speed when the engine speed increases from a low value will be referred to as "first engine speed."

Meanwhile, as denoted by the two dot chain line in FIG. 8(*b*), when the engine 7 operates at high engine speed, the tip end of the cam nose of the intake cam 231 is at position T2. When the engine speed of the engine 7 is lowered from this state and below a prescribed engine speed, the tip end of the cam nose of the intake cam 231 moves to position T1. Hereinafter, the prescribed engine speed when the engine speed drops from a high value is referred to as "second engine speed."

In this way, according to the present preferred embodiment, the phase of the intake cam 231 relative to the exhaust cam 241 changes depending on the engine speed of the engine 7 and changes in the engine speed (increase and decrease in the engine speed). In FIG. 8(*b*), the change amount in the phase of the intake cam 231 is represented by angle θ.

As described above, the valve timing is different between when the engine 7 operates at low engine speed and when the engine operates at high engine speed. When the engine 7 operates at low engine speed, the overlap amount between the period in which the intake valve is open and the period in which the exhaust valve is open is small, so that toxic substances in the exhaust gas are reduced, which reduces the fuel consumption. When the engine 7 operates at high engine speed, the overlap amount between the period in which the intake valve is open and the period in which the exhaust valve is open is large, so that high power can efficiently be provided.

Figure 9:
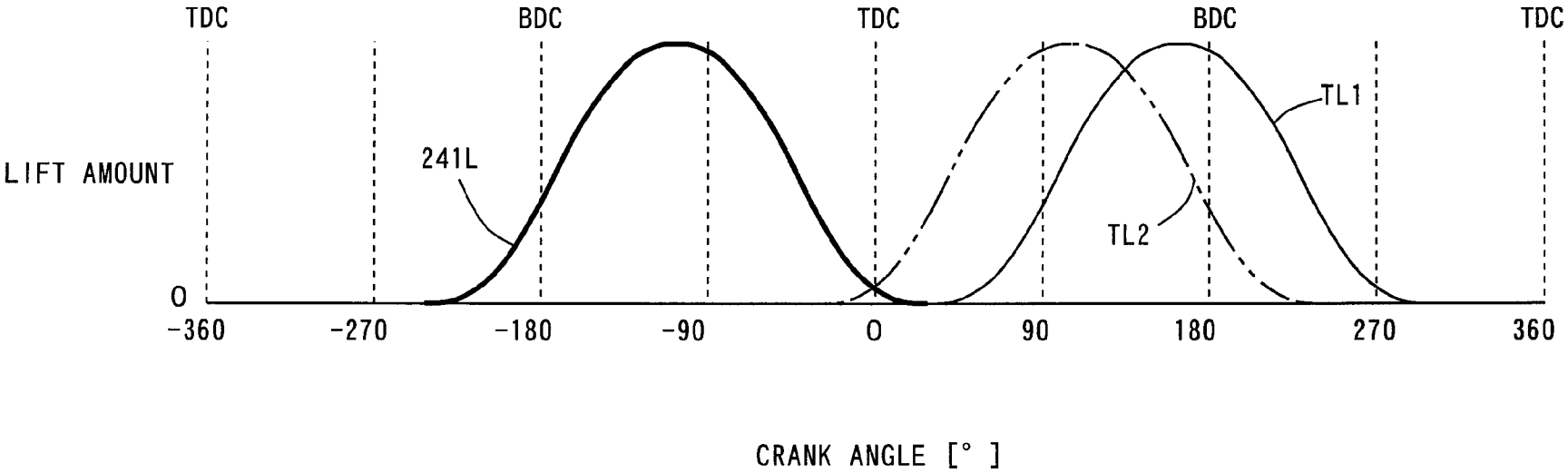
FIG. 9 is a chart for use in illustrating the relation between the phases of the exhaust cam and the intake cam relative to the crank shaft in FIGS. 2(*a*) and 2(*b*) and the lift amounts of the exhaust valve and the intake valve as the crank shaft rotates.

Changes in the overlap amount caused by changes in the phase of the intake cam 231 relative to the exhaust cam 241 will be described in conjunction with FIG. 9. FIG. 9 is a view for use in illustrating the relation between the phases of the exhaust cam 241 and the intake cam 231 relative to the crankshaft 23 in FIG. 2 and the lift amounts of the exhaust valve 344 and the intake valve 334 as the crankshaft 23 rotates.

In FIG. 9, the abscissa represents the crank angle (the rotational angle of the crank shaft 23), and the ordinate represents the lift amounts of the exhaust valve 344 and the intake valve 334 (the displacements of the exhaust valve 344 and the intake valve 334 in the upper and lower directions).

In FIG. 9, the exhaust valve 344 and the intake valve 334 are open when the lift amounts are greater than zero, and closed when the lift amounts are zero.

The crank angle ranges from −360° to +360°. When the crank angle is 0°, 360°, and −360°, the piston 21 is positioned at the top dead center TDC in the cylinder 20, and when the crank angle is 180° and −180°, the piston 21 is positioned at the bottom dead center BDC in the cylinder 20.

The thick solid line 241L in FIG. 9 shows changes in the lift amount of the exhaust valve 344 caused by the rotation of the exhaust cam 241. As denoted by the thick solid line 241L, the lift amount of the exhaust valve 344 increases for the crank angle approximately in the range from −240° to −110°, and decreases for the crank angle approximately in the range from −110° to 20°.

The solid line TL1 in FIG. 9 shows changes in the lift amount of the intake valve 334 caused by the rotation of the intake cam 231 when the engine 7 operates at low engine speed. As denoted by the solid line TL1, the lift amount of the intake valve 334 increases for the crank angle approximately in the range from 40° to 170°, and decreases for the crank angle approximately in the range from 170° to 300°.

As described above, when the engine 7 operates at low engine speed, the overlap amount between the period in which the intake valve 334 is open and the period in which the exhaust valve 344 is open is small. In the example in FIG. 9, the overlap amount is zero.

Meanwhile, the dash double dotted line TL2 in FIG. 9 represents the lift amount of the intake valve 334 caused by the rotation of the intake cam 231 when the engine 7 operates at high engine speed. As denoted by the dash double dotted line TL2, the lift amount of the intake valve 334 increases for the crank angle approximately in the range from −30° to 100°, and decreases for the crank angle approximately in the range from 100° to 230°.

In this way, when the engine 7 operates at high engine speed, the overlap amount between the period in which the intake valve 334 is open and the period in which the exhaust valve 344 is open is large.

In this way, the phase of the intake cam 231 changes by angle θ relative to the exhaust cam 241 between when the engine 7 operates at low engine speed and when the engine operates at high engine speed, so that the overlap amount between the period in which the exhaust valve 344 is open and the period in which the intake valve 334 is open changes, and the above described advantages can be provided.

Note that in the valve timing control device 200 according to the present preferred embodiment, as shown in FIG. 6, the lock pin holding mechanism 210 has a relatively small length in the Y-direction. In this way, the valve timing control device 200 has great flexibility in attachment (flexibility in layout), and good general versatility. Therefore, the valve timing control device 200 can also be applied effectively to an engine having a structure other than that described above.

FIGS. 10 to 14 are cutaway perspective views for use in illustrating the operation of the valve timing control device 200. In FIGS. 10 to 14, in the valve timing control device 200, the lock pin holding mechanism 210, the cam driven sprocket 220, and the intake camshaft 230 are partly cut away.

In FIGS. 10 to 14, the direction denoted by the arrow Z is defined as the Z-direction. Note that the direction of the arrow in the Z-direction is defined as the + direction, while the direction opposite to the direction is defined as the – direction. The dashed line represents the axial center J of the valve timing control device 200.

Figure 10:
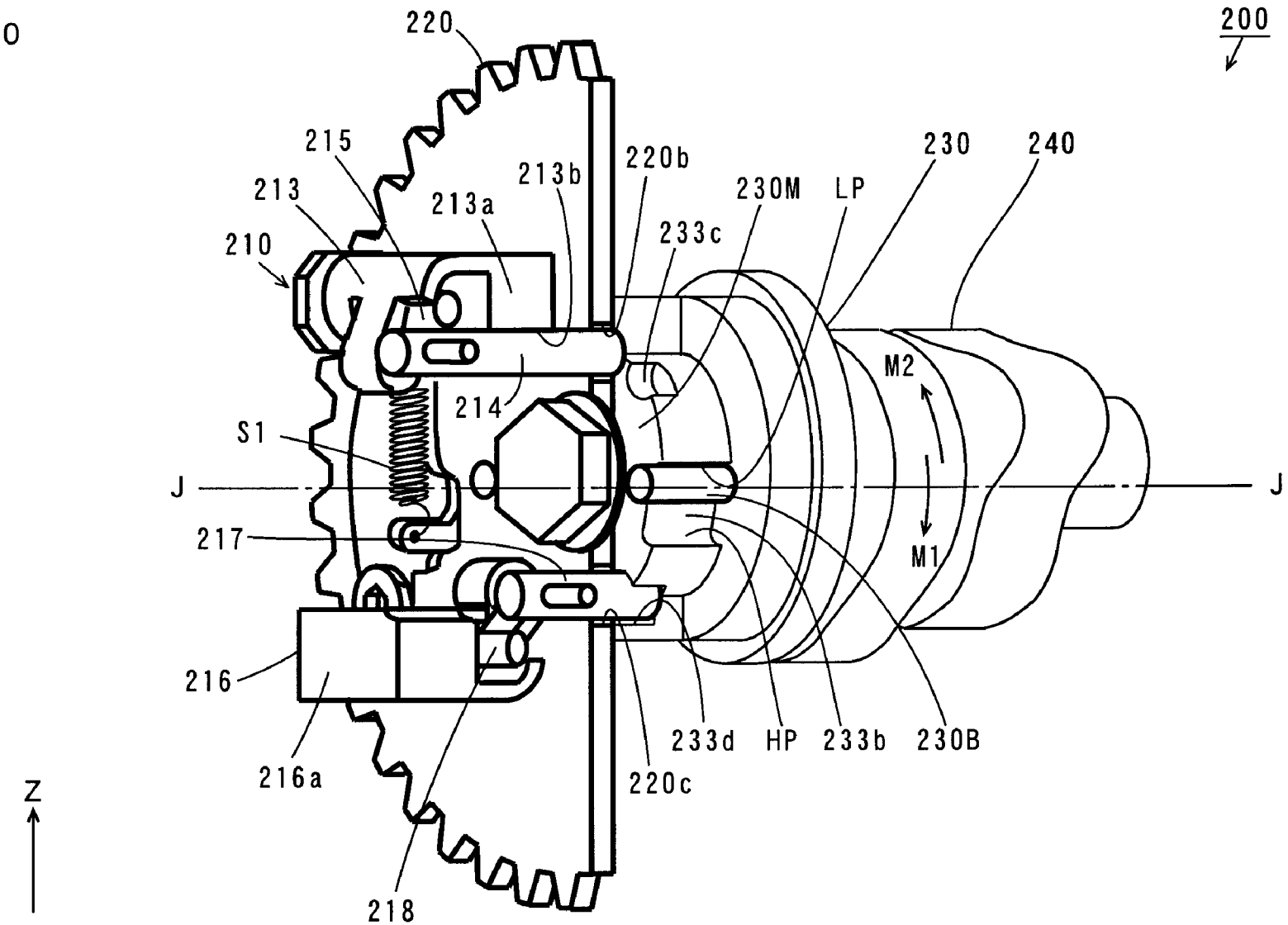
FIG. 10 is a cutaway perspective view for use in illustrating the operation of the valve timing control device.

FIG. 10 shows the state of the valve timing control device 200 when the assembling of the device is completed. In FIG. 10, the lock pin holding mechanism 210 and the cam driven sprocket 220 are cut away in the Z-direction from the center. The fixing pin 230B is actually connected to the cam driven sprocket 220 as described above.

As shown in FIG. 10, when the assembling of the valve timing control device 200 is completed, the weight main body 213*a* of the weight 213 is biased in the –Z-direction by the spring S1. Here, the weight 213 holds the high speed lock pin 214 inserted in the through hole 220*b* of the cam driven sprocket 220. In this way, the rotation operation of the weight 213 around the pivot shaft 215 is limited. In this state, a portion of the high speed lock pin 214 abuts against the groove 213*b* of the weight 213.

Meanwhile, the weight main body 216*a* of the weight 216 is biased in the +Z-direction by the spring S2 that is not shown (see FIG. 4). Here, the weight 216 holds the low speed lock pin 217 inserted in the through hole 220*c* of the cam driven sprocket 220. In this way, the rotation operation of the weight 216 around the pivot shaft 218 is restricted.

In FIG. 10, one end of the high speed lock pin 214 inserted in the cam driven sprocket 220 substantially abuts against a contact surface 230M that is perpendicular or substantially perpendicular to the axial center J of the intake camshaft 230.

Meanwhile, the low speed lock pin 217 is inserted in the low speed pin introduction hole 233*d* of the intake camshaft 230. One end of the low speed lock pin 217 inserted in the low speed pin introduction hole 233*d* substantially abuts against the bottom surface of the low speed pin introduction hole 233*d*.

As described above, the groove 233*b* for floating a pin extends in the circumferential direction around the axial center J. Here, one end of the groove 233*b* for floating a pin in the circumferential direction is referred to as "low speed groove end LP" and the other end of the groove 233*b* for floating a pin in the circumferential direction is referred to as "high speed groove end HP."

In FIG. 10, the fixing pin 230B inserted in the groove 233*b* for floating a pin is positioned at the low speed groove end LP. The fixing pin 230B is fixed to the cam driven sprocket 220, so that the rotation of the intake camshaft 230 in the direction denoted by the arrow M1 relative to the cam driven sprocket 220 and the exhaust camshaft 240 is restricted.

However, in the state in FIG. 10, the low speed lock pin 217 is inserted in the low speed pin introduction hole 233*d*, and therefore the intake camshaft 230 cannot rotate relative to the cam driven sprocket 220 and the exhaust camshaft 240 either in the direction denoted by the arrow M1 or M2.

Figure 11:
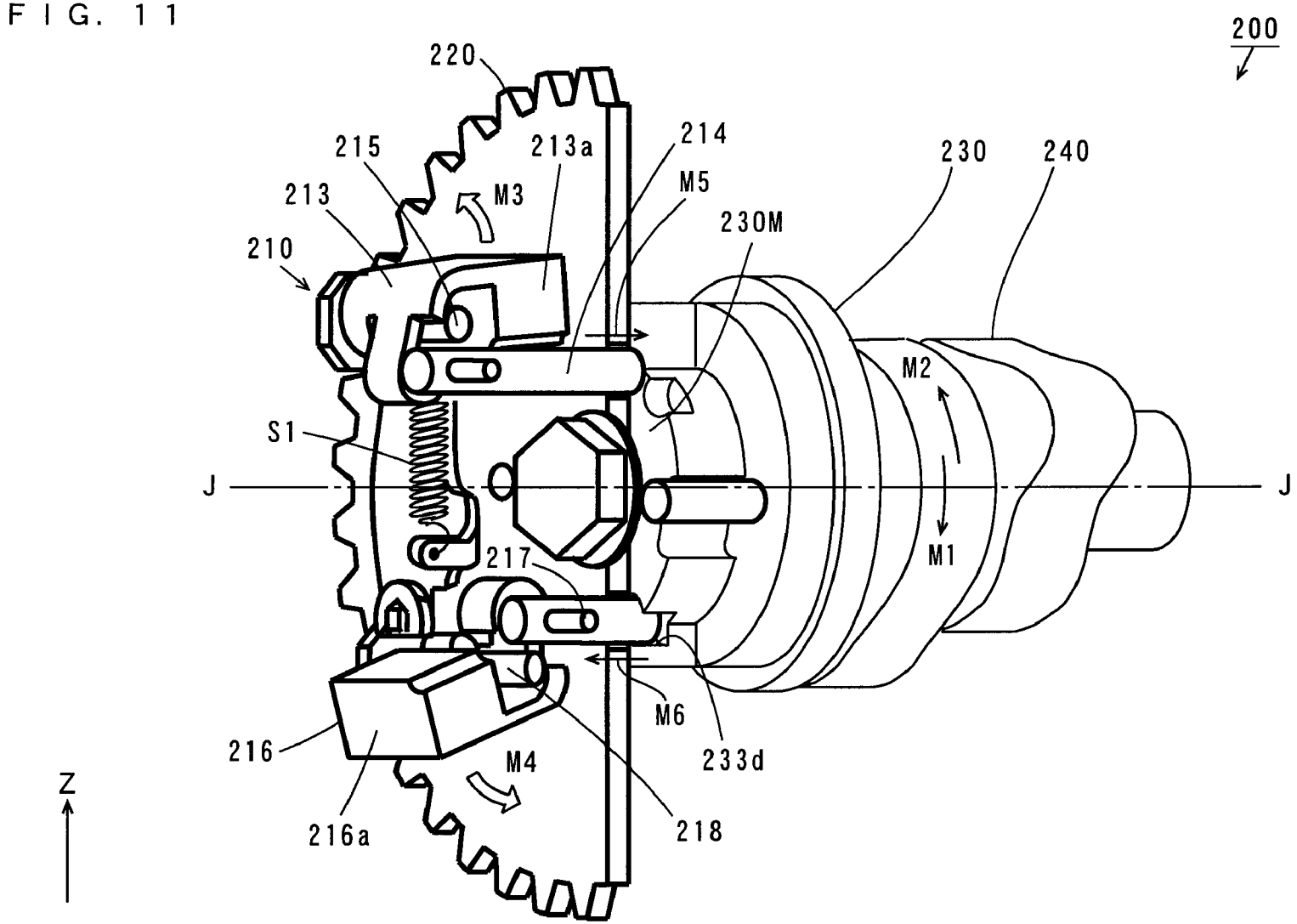
FIG. 11 is a cutaway perspective view for use in illustrating the operation of the valve timing control device.

FIG. 11 shows the state of the valve timing control device 200 at low engine speed. In the valve timing control device 200 operating at low engine speed, a small centrifugal force acts on the weights 213 and 216. This generates a force to rotate the weight main body 213*a* around the pivot shaft 215 as indicated by the thick arrow M3. The force to rotate the weight main body 216*a* around the pivot shaft 218 is generated as indicated by the thick arrow M4.

In this case, the rotation of the weight main body 216*a* in the direction of the thick arrow M4 generates a force to pull out the low speed lock pin 217 held by the weight 216 from the low speed pin introduction hole 233*d* of the intake camshaft 230 (see the arrow M6).

At low engine speed, the spring S2 that is not shown (see FIG. 4) biases the weight main body 216*a* in the +Z direction, and therefore the elastic force by the spring S2 and the force acting in the direction of the thick arrow M4 are balanced. Consequently, the low speed lock pin 217 is not completely pulled out from the low speed pin introduction hole 233*d*.

Meanwhile, once the force acting in the direction of the thick arrow M3 is generated at the weight main body 213*a*, the force is generated in the direction in which the high speed lock pin 214 held by the weight 213 is drawn to the intake camshaft 230 (see the arrow M5). However, one end of the low speed lock pin 217 abuts against the contact surface 230M, and therefore the high speed lock pin 214 does not move toward the axial center J. Consequently, the weight main body 213*a* does not rotate.

Figure 12:
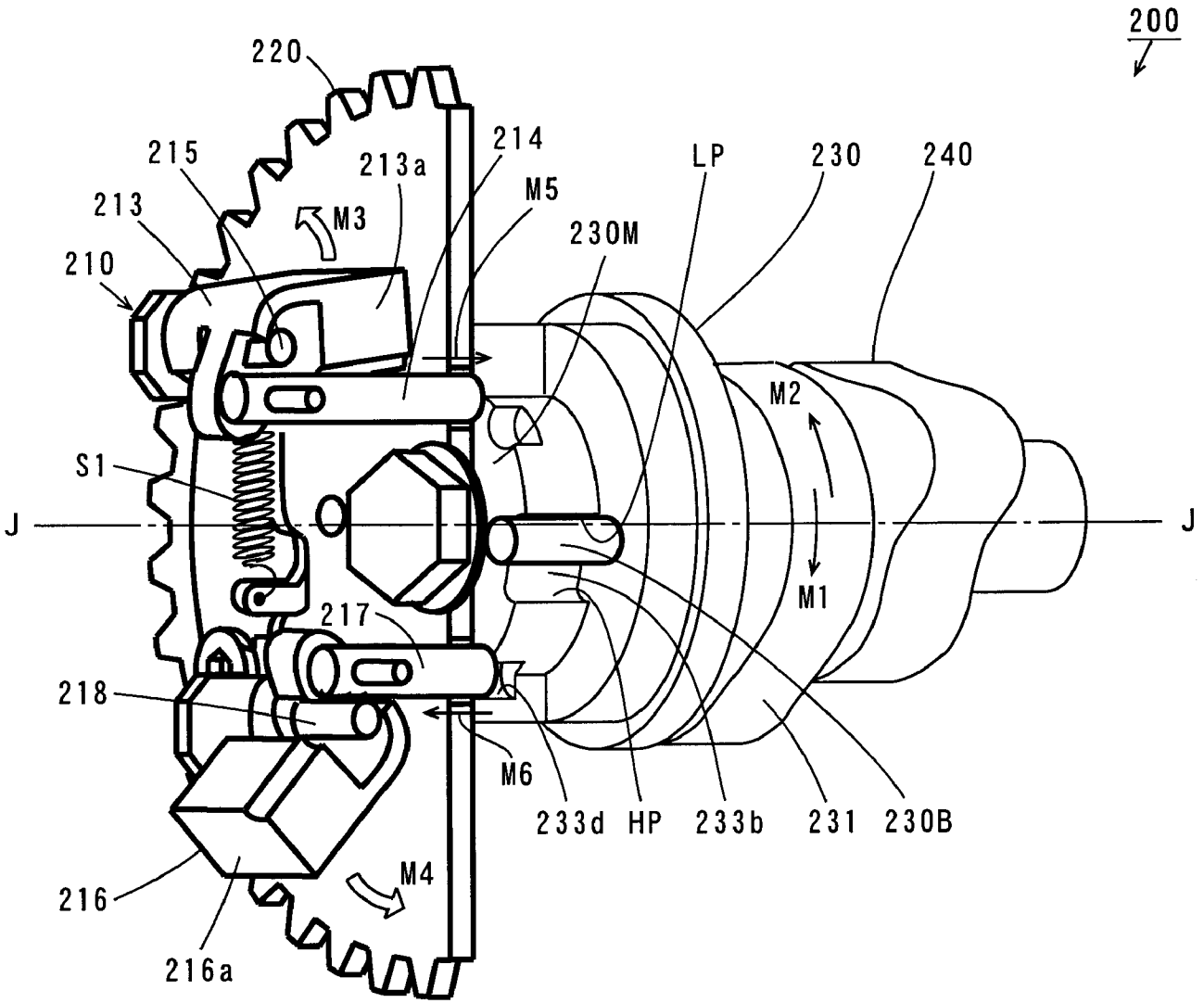
FIG. 12 is a cutaway perspective view for use in illustrating the operation of the valve timing control device.
Figure 13:
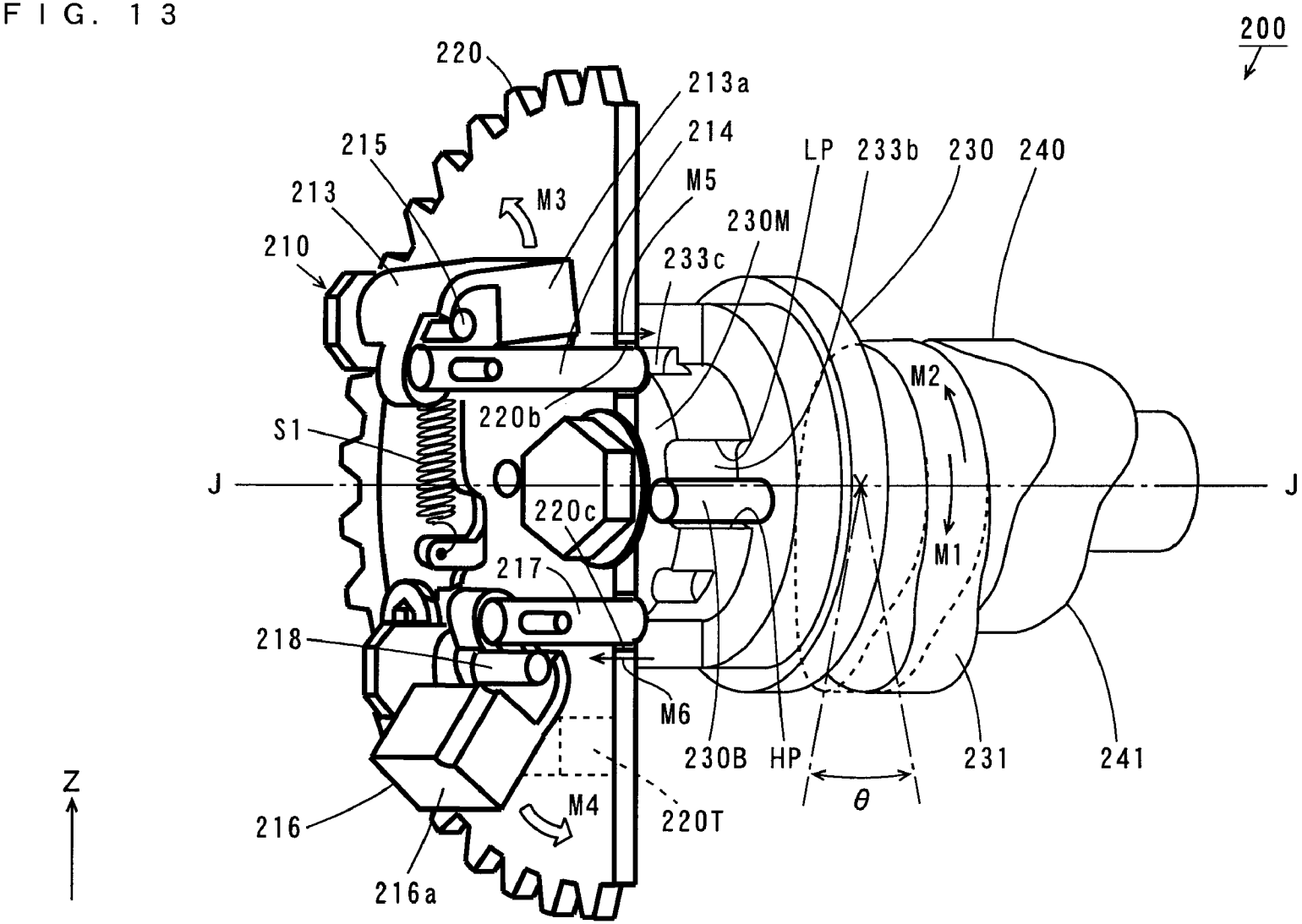
FIG. 13 is a cutaway perspective view for use in illustrating the operation of the valve timing control device.

FIGS. 12 and 13 show the state of the valve timing control device 200 when the engine speed of the engine 7 is raised to the first engine speed.

As describe above, when the valve timing control device 200 rotates, a centrifugal force acts on the weights 213 and 216. When the engine speed of the engine 7 changes from a low value to a high value, a larger centrifugal force is exerted on the weights 213 and 216.

In this way, the force acting in the direction of the thick arrow M4 generated at the weight main body 216*a* is greater than the elastic force of the spring S2 in FIG. 4, and becomes greater than the force acting in the direction of the arrow M6 to pull out the low speed lock pin 217 from the low speed pin introduction hole 233*d*.

As a result, as shown in FIG. 12, the engine speed attains the first engine speed, and the low speed lock pin 217 is pulled out from the low speed pin introduction hole 233*d*. In this state, the centrifugal force by the weight 213 is generated in the direction of the arrow M5 at the high speed lock pin 214.

As described above, when the low speed lock pin 217 is pulled out from the low speed pin introduction hole 233*d*, the intake camshaft 230 is allowed to rotate relative to the cam driven sprocket 220 and the exhaust camshaft 240.

However, the fixing pin 230B inserted in the groove 233*b* for floating a pin is positioned at the low speed groove end LP. Therefore, the intake camshaft 230 is allowed to rotate only in the direction of the arrow M2.

Now, as described in conjunction with FIG. 8(*a*), the elastic force of the valve spring 335 is transmitted to the intake cam 231 of the intake camshaft 230 through the roller rocker arm 330.

In this way, at the intake camshaft 230, force to rotate the cam driven sprocket 220 and the exhaust camshaft 240 in the direction of the arrow M1 or M2 is generated.

The force to rotate the intake camshaft 230 in the direction of the arrow M1 or M2 will be described in conjunction with FIG. 8(*a*).

As shown in FIG. 8(*a*), the roller 330T of the roller rocker arm 330 abuts against the upper end of the intake cam 231. In this case, the upper end of the intake cam 231 is biased downwardly by the elastic force of the valve spring 335.

When the intake cam 231 rotates in the direction of the arrow Q2 and the cam nose comes near the roller 330T, a force to press the intake cam 231 downwardly by the roller 330T acts to rotate the intake cam 231 in the direction opposite to the direction of the arrow Q2.

Similarly, when the intake cam 231 rotates in the direction of the arrow Q2 and the cam nose moves away from the roller 330T, a force to press the intake cam 231 downwardly by the roller 330T acts to rotate the intake cam 231 in the direction of the arrow Q2. In this example, the arrow Q2 in FIGS. 8(*a*) and 8(*b*) corresponds to the arrow M2.

In the state in FIG. 12, the force acts to rotate the intake camshaft 230 in the direction of the arrow M2, so that the intake camshaft 230 rotates in the direction of the arrow M2 relative to the cam driven sprocket 220 and the exhaust camshaft 240.

As shown in FIG. 13, as the intake camshaft 230 rotates in the direction of the arrow M2, the groove 233*b* for floating a pin having the fixing pin 230B inserted therein rotates around the axial center J. In this example, the groove 233*b* for floating a pin has the low speed groove end LP and the high speed groove end HP as described above. Therefore, the rotation of the groove 233*b* for floating a pin in the direction of the arrow M2 is restricted by the high speed groove end HP.

In this way, the rotation of the intake camshaft 230 in the direction of the arrow M2 is restricted by positioning the fixing pin 230B at the high speed groove end HP of the groove 233*b* for floating a pin.

Therefore, when the fixing pin 230B is positioned at the high speed groove end HP of the groove 233*b* for floating a pin, the high speed pin introduction hole 233*c* is in communication with the through hole 220*b* of the cam driven sprocket 220. Consequently, the high speed lock pin 214 in abutment against the contact surface 230M has one end inserted into the high speed pin introduction hole 233*c* by the centrifugal force acting on the weight 213 (see FIG. 14).

As the intake camshaft 230 rotates as described above, the phase of the intake cam 231 relative to the exhaust cam 241 changes by angle θ. In this way, the valve timing of the engine 7 changes stably as it is unaffected by the elastic force of the valve springs 335 and 345.

Note that although the operation of the groove 233*a* for floating a pin (see FIG. 4) that is not shown in FIGS. 10 to 14 is not described, the operation of the groove 233*a* for floating a pin is the same as that of the groove 233*b* for floating a pin.

In FIG. 13, the projection 220T in FIG. 3 is indicated by a broken line. The projection 220T is provided to restrict the rotation of the weight main body 216*a* around the pivot shaft 218. For example, if the weight main body 216*a* rotates by a prescribed amount, one surface of the weight main body 216*a* abuts against the projection 220T. In this way, the weight main body 216*a* rotates largely in the direction of the arrow M4, and the low speed lock pin 217 is prevented from being pulled out from the through hole 220*c*.

Figure 14:
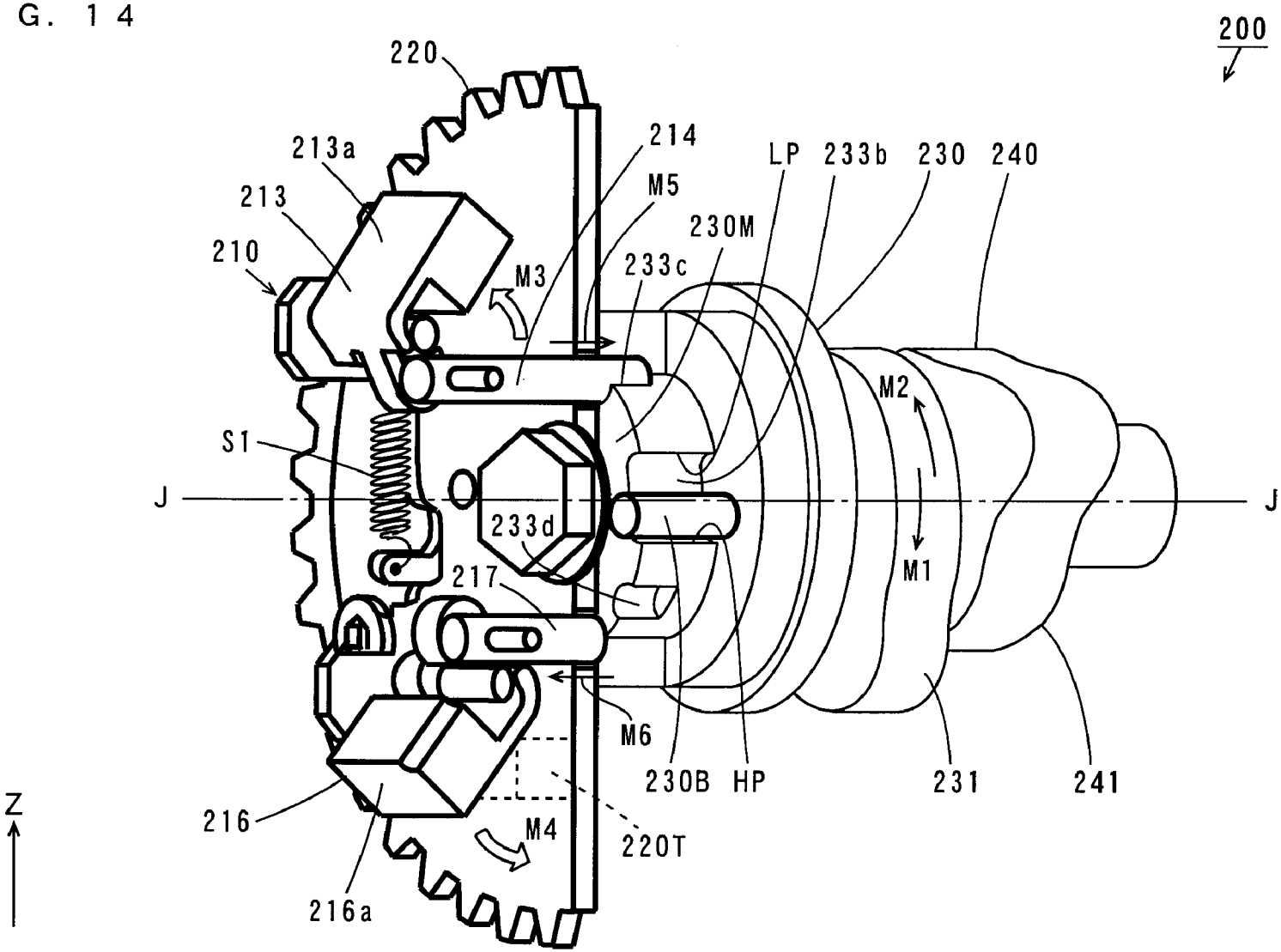
FIG. 14 is a cutaway perspective view for use in illustrating the operation of the valve timing control device.

FIG. 14 shows the state of the valve timing control device 200 after change in the valve timing of the engine 7 based on the first engine speed.

As described above, after the change in the valve timing of the engine 7 based on the first engine speed, the high speed lock pin 214 has one end inserted through the high speed pin introduction hole 233*c*. In this way, the intake camshaft 230 cannot rotate either in the direction of the arrow M1 or M2. Therefore, at high engine speed, the phase relation between the intake cam 231 and the exhaust cam 241 is fixed to a phase relation different from the phase relation at low engine speed.

Meanwhile, when the engine speed of the engine 7 is lowered from a high value, and the engine 7 operates at the second engine speed, an operation opposite to that described above is carried out.

More specifically, in FIG. 14, when the engine speed of the engine 7 is lowered from a high value to the second engine speed, the weight main body 213*a* rotates in the direction opposite to the direction of the thick arrow M3 by the elastic force of the spring S1. Consequently, one end of the high speed lock pin 214 is pulled out from the high speed pin introduction hole 233*c* of the intake camshaft 230.

In FIG. 14, the weight main body 216*a* rotates in the opposite direction to the direction of the thick arrow M4 by the elastic force of the spring S2 that is not shown (see FIG. 4). Consequently, one end of the low speed lock pin 217 is pressed against the contact surface 230M of the intake camshaft 230.

As described above, at the intake camshaft 230, a force to rotate the cam driven sprocket 220 and the exhaust camshaft 240 in the direction of M1 or M2 is generated.

In this way, the elastic force of the valve spring 335 acting on the intake cam 231 rotates the intake camshaft 230 in the direction of M1. Then, the low speed lock pin 217 is inserted into the low speed pin introduction hole 233*d* of the intake camshaft 230, so that the intake camshaft 230 is fixed. As a result, the valve timing of the engine 7 changes stably without being affected by the elastic force of the valve springs 335 and 345.

As described above, the valve timing changes at different engine speeds between when the engine speed of the engine 7 is raised and when the engine speed is lowered. More specifically, the first and second engine speeds are different.

The first and second engine speeds are achieved based on conditions set for the elements of the valve timing control device 200. For example, the springs S1 and S2 preferably have different elastic forces from each other. In this case, force acting on the high speed lock pin 214 held by the weight 213 and the force acting on the low speed lock pin 217 held by the weight 216 are different.

Consequently, the engine speed at which the high speed lock pin 214 is pulled out from the high speed pin introduction hole 233*c* (second engine speed) and the engine speed at which the lower speed lock pin 217 is pulled out from the low speed pin introduction hole 233*d* (first engine speed) are different.

In this way, the valve timing changes at different engine speeds between when the engine speed of the engine 7 is raised and when the engine speed is lowered. Therefore, hunting, in other words, unstable behavior of the valves caused by the effect of the elastic force of the valve springs 335 and 345 in response to a change in the valve timing is sufficiently prevented. Consequently, a change in the cam profile caused by hunting can be prevented, so that the performance and durability of the engine can be prevented from degrading.

As in the foregoing, according to the present preferred embodiment, as the engine speed of the engine 7 is raised, the phase of the intake camshaft 230 relative to the exhaust camshaft 240 is changed by the lock pin holding mechanism 210 at the first engine speed. In this state, the opening/closing timings of the exhaust valve 344 and the intake valve 334 are controlled.

As the engine speed of the engine 7 is lowered, the phase of the intake camshaft 230 relative to the exhaust camshaft 240 is changed by the lock pin holding mechanism 210 at a second engine speed lower than the first engine speed. In this state, the opening/closing timings of the exhaust valve 344 and the intake valve 334 are controlled.

In this way, the first engine speed during an acceleration of the engine 7 and the second engine speed during a deceleration of the engine 7 are different, so that the phase of the intake camshaft 230 relative to the exhaust camshaft 240 is not repeatedly changed when the engine speed of the engine 7 is maintained in the range of the first or second engine speed. Therefore, hunting that could cause the behavior of the exhaust valve 344 and the intake valve 334 to be unstable can sufficiently be prevented.

Furthermore, according to the present preferred embodiment, the phase of the intake camshaft 230 relative to the exhaust camshaft 240 is switched without using frictional force between components but rather uses complementary movements between the low speed lock pin 217 and low speed pin introduction hole 233*d* and the high speed lock pin 214 and the high speed pin introduction hole 233*c*. Therefore, there is little degradation caused by abrasion between the components. As a result, the useful life of the valve timing control device 200 can be prolonged without having to use wear resistant components, and the device can be manufactured less costly.

High working precision is not required, and the complementary movements between the low speed lock pin 217 and the low speed pin introduction hole 233*d* and the high speed lock pin 214 and the high speed pin introduction hole 233*c* can be achieved simply by a mechanical arrangement, so that the device can be more readily manufactured.

There is no need for a control system including a hydraulic circuit, an electric circuit, and software used to control the complementary movements between the low speed lock pin 217 and the low speed pin introduction hole 233*d* and the high speed lock pin 214 and high speed pin introduction hole 233*c*. This allows the valve timing control device to have a reduced size.

OTHER PREFERRED EXAMPLES

According to the above preferred embodiments, the valve timing control device 200 is preferably provided in an engine 7 of the SOHC (single overhead camshaft) type, but the valve timing control device 200 may be provided in any engine as far as the engine 7 has a camshaft.

For example, the engine 7 may be an engine of the SV (side valve) type, OHV (overhead valve) type, or DOHC (double overhead camshaft) type.

As described in conjunction with FIG. 8(*a*), although the valve timing control device 200 is preferably provided in an engine 7 including roller rocker arms 330 and 340, the device 200 may be provided in an engine of direct striking type.

As described in conjunction with FIGS. 10 to 14, the valve timing control device 200 preferably includes the springs S1 and S2 in order to bias the weight main bodies 213*a* and 216*a* in prescribed directions. However, rubber members or the like may be used instead of the springs S1 and S2 as far as the elastic members can bias the weight main bodies 213*a* and 216*a* in the prescribed directions.

Furthermore, the above preferred embodiments have been described with respect to a motorcycle as the vehicle by way of illustration, but the valve timing control device 200 may be provided in an engine in a small vehicle with a small displacement such as a tractor, a cart, or a small ship.

In the foregoing, according to the above preferred embodiments, the engine 7 may correspond to the engine; the exhaust valve 344 may correspond to the first valve; the intake valve 334 may correspond to the second valve; the valve timing control device 200 may correspond to the valve timing control device; the cam driven sprocket 220 may correspond to the rotation member; the exhaust camshaft 240 may correspond to the first camshaft; the intake camshaft 230 may correspond to the second camshaft; the lock pin holding mechanism 210 may correspond to the phase changing mechanism; the low speed lock pin 217 and the low speed pin introduction hole 233*d* may correspond to the first engaging mechanism; and the high speed lock pin 214 and the high speed pin introduction hole 233*c* may correspond to the second engaging mechanism.

The low speed pin introduction hole 233*d* may correspond to the first engaging portion; the low speed lock pin 217 may correspond to the first engagement member; the spring S2 may correspond to the first biasing member; the weight main body 216*a* may correspond to the first weight; the high speed pin introduction hole 233*c* may correspond to the second engaging portion; the high speed lock pin 214 may correspond to the second engagement member; the spring S1 may correspond to the second biasing member; and the weight main body 213*a* may correspond to the second weight.

Furthermore, the low speed pin introduction hole 233*d* may correspond to the first hole; the low speed lock pin 217 may correspond to the first pin member; the high speed pin introduction hole 233*c* may correspond to the second hole; the high speed lock pin 214 may correspond to the second pin member; and the fixing pins 230A and 230B and the grooves 233*a* for floating a pin and 233*b* may correspond to the restricting mechanism or the preventing mechanism.

Furthermore, the grooves 233*a* and 233*b* for floating a pin may correspond to the grooves; the low speed groove end LP and the high speed groove end HP may correspond to both end surfaces in the grooves; the fixing pins 230A and 230B may correspond to the abutment members; the engine 7 may correspond to the engine device; and the motorcycle 100 may correspond to the vehicle.

As shown in FIG. 8(*b*), the phase of the intake cam 231 relative to the exhaust cam 241 indicated by the solid line may correspond to the first phase and the phase of the intake cam 231 relative to the exhaust cam 241 indicated by the dash double dotted line may correspond to the second phase.

The preferred embodiments of the present invention are applicable to various vehicles and crafts having an engine such as a motorcycle and a four-wheeled automobile.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A valve timing control device for controlling opening/closing timings of first and second valves in response to a speed of an engine, comprising:

a rotation member arranged to rotate in synchronization with a rotation of the engine;

a first camshaft arranged to abut against the first valve and rotate together with the rotation member to open/close the first valve;

a second camshaft arranged to abut against the second valve and rotate relative to the first camshaft, the second camshaft arranged to rotate together with the rotation member to open/close the second valve; and a phase changing mechanism arranged to change a phase of the second camshaft relative to the first camshaft between first and second phases; wherein the phase changing mechanism changes the phase of the second camshaft relative to the first camshaft from the first phase to the second phase at a first engine speed during an increase of the engine speed of the engine; wherein the phase changing mechanism changes the phase of the second camshaft relative to the first camshaft from the second phase to the first phase at a second engine speed lower than the first speed during a decrease of the engine speed of the engine; and the phase changing mechanism includes:

a first engaging mechanism arranged to engage the second camshaft while the second camshaft has the first phase relative to the first camshaft; and a second engaging mechanism arranged to engage the second camshaft while the second camshaft has the second phase relative to the first camshaft; wherein the first engaging mechanism is biased in a direction to engage the second camshaft and arranged to move in a direction to pull out the second camshaft by centrifugal force; and the second engaging mechanism is biased in a direction to pull out the second camshaft and arranged to move in a direction to engage the second camshaft by centrifugal force.

2. The valve timing control device according to claim 1, wherein the first engaging mechanism includes:

a first engaging portion provided on the second camshaft;

a first engagement member arranged to move between a state of being engaged with the first engaging portion and a state of being pulled out from the first engaging portion;

a first biasing member arranged to bias the first engagement member in the direction in which the first engagement member is to be engaged with the first engaging portion; and a first weight arranged to move the first engagement member in a direction in which the first engagement member is to be pulled out from the first engaging portion by centrifugal force; and the second engaging mechanism includes:

a second engaging portion provided on the second camshaft;

a second engagement member arranged to move between a state of being engaged with the second engaging portion and a state of being pulled out from the second engaging portion;

a second biasing member arranged to bias the second engagement member in a direction in which the second engagement member is to be pulled out from the second engaging portion; and a second weight arranged to move the second engagement member in a direction in which the second engagement member is to be engaged with the second engaging portion by centrifugal force; wherein the second camshaft is arranged to rotate relative to the first camshaft between the first phase and the second phase while the first engagement member is pulled out from the first engaging portion and the second engagement member is pulled out from the second engaging portion.

3. The valve timing control device according to claim 2, wherein the first engaging portion includes a first hole provided in the second camshaft;

the first engagement member includes a first pin member arranged to move between a state of being inserted into the first hole and a state of being pulled out from the first hole;

the second engaging portion includes a second hole provided in the second camshaft; and the second engagement member includes a second pin member arranged to move between a state of being inserted into the second hole and a state of being pulled out from the second hole.

4. The valve timing control device according to claim 1, wherein the phase changing mechanism further includes a restricting mechanism arranged to restrict rotation of the second camshaft relative to the first camshaft within the range between the first phase and the second phase.

5. The valve timing control device according to claim 4, wherein the restricting mechanism includes a preventing mechanism arranged to prevent the second camshaft from rotating when the phase of the second camshaft relative to the first camshaft changes from the first phase to the second phase, and from the second phase to the first phase.

6. The valve timing control device according to claim 5, wherein the preventing mechanism includes:

a groove arranged in the circumferential direction of the second camshaft; and an abutment member fixed to the rotation member and arranged so that the abutment member can move in the groove and abut against both end surfaces in the groove.

7. An engine device comprising:

an engine having first and second valves; and a valve timing control device arranged to control opening/closing timings of the first and second valves in response to an engine speed of the engine, the valve timing control device including:

a rotation member arranged to rotate in synchronization with a rotation of the engine;

a first camshaft arranged to abut against the first valve and rotate together with the rotation member to open/close the first valve;

a second camshaft arranged to abut against the second valve and rotate relative to the first camshaft, the second camshaft being rotated together with the rotation member to open/close the second valve; and a phase changing mechanism arranged to change a phase of the second camshaft relative to the first camshaft between first and second phases; wherein the phase changing mechanism changes the phase of the second camshaft relative to the first camshaft from the first phase to the second phase at a first engine speed during an increase of the engine speed of the engine;

the phase changing mechanism changes the phase of the second camshaft relative to the first camshaft from the second phase to the first phase at a second engine speed lower than the first speed during a decrease of the engine speed of the engine; and the phase changing mechanism includes:

a first engaging mechanism arranged to engage the second camshaft while the second camshaft has the first phase relative to the first camshaft; and a second engaging mechanism arranged to engage the second camshaft while the second camshaft has the second phase relative to the first camshaft; wherein the first engaging mechanism is biased in a direction to engage the second camshaft and arranged to move in a direction to pull out the second camshaft by centrifugal force; and the second engaging mechanism is biased in a direction to pull out the second camshaft and arranged to move in a direction to engage the second camshaft by centrifugal force.

8. A vehicle comprising:

an engine device;

driving wheels; and a transmission mechanism arranged to transmit power generated by the engine device to the driving wheels;

the engine device including:

an engine having first and second valves; and a valve timing control device arranged to control opening/closing timings of the first and second valves in response to an engine speed of the engine, the valve timing control device including:

a rotation member arranged to rotate in synchronization with a rotation of the engine;

a first camshaft arranged to abut against the first valve and rotate together with the rotation member to open/close the first valve;

a second camshaft arranged to abut against the second valve and rotate relative to the first camshaft, the second camshaft being rotated together with the rotation member to open/close the second valve; and a phase changing mechanism arranged to change a phase of the second camshaft relative to the first camshaft between first and second phases; wherein the phase changing mechanism changes the phase of the second camshaft relative to the first camshaft from the first phase to the second phase at a first engine speed during an increase of the engine speed of the engine;

the phase changing mechanism changes the phase of the second camshaft relative to the first camshaft from the second phase to the first phase at a second engine speed lower than the first engine speed during a decrease of the engine speed of the engine; and the phase changing mechanism includes:

a first engaging mechanism arranged to engage the second camshaft while the second camshaft has the first phase relative to the first camshaft; and a second engaging mechanism arranged to engage the second camshaft while the second camshaft has the second phase relative to the first camshaft; wherein the first engaging mechanism is biased in a direction to engage the second camshaft and arranged to move in a direction to pull out the second camshaft by centrifugal force; and the second engaging mechanism is biased in a direction to pull out the second camshaft and arranged to move in a direction to engage the second camshaft by centrifugal force.

* * * * *